US008276290B2

(12) United States Patent
Uhara et al.

(10) Patent No.: US 8,276,290 B2
(45) Date of Patent: Oct. 2, 2012

(54) WASHING AND DRYING MACHINE AND CLOTHES DRYER

(75) Inventors: Hiroko Uhara, Nara (JP); Shinya Takagi, Kashiba (JP); Masahiro Nishiyama, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 345 days.

(21) Appl. No.: 12/488,395

(22) Filed: Jun. 19, 2009

(65) Prior Publication Data

US 2009/0249837 A1 Oct. 8, 2009

Related U.S. Application Data

(63) Continuation of application No. 10/582,171, filed as application No. PCT/JP2004/018180 on Dec. 7, 2004, now abandoned.

(30) Foreign Application Priority Data

Dec. 10, 2003 (JP) ..... 2003-411184
Dec. 18, 2003 (JP) ..... 2003-421286
Jun. 28, 2004 (JP) ..... 2004-190044

(51) Int. Cl.
*F26B 11/02* (2006.01)

(52) U.S. Cl. ..... 34/275; 34/381; 34/497; 68/12.01; 68/3 R; 8/158; 8/142

(58) Field of Classification Search ..... 34/260, 34/274, 275, 92, 601, 380, 381, 497; 8/158, 8/142; 68/3 R, 12.01
See application file for complete search history.

(56) References Cited

U.S. PATENT DOCUMENTS

| | | | | | |
|---|---|---|---|---|---|
| 1,690,024 | A | | 10/1928 | Lewis | |
| 1,756,821 | A | | 4/1930 | Groen | |
| 2,137,376 | A | | 11/1938 | Altorfer | |
| 2,221,351 | A | | 11/1940 | Kempf | |
| 2,298,095 | A | * | 10/1942 | Dunham | 68/12.01 |
| 2,638,424 | A | * | 5/1953 | Hansgirg | 134/3 |
| 2,727,315 | A | * | 12/1955 | Candor | 34/543 |
| 2,742,708 | A | * | 4/1956 | McCormick | 34/76 |
| 3,652,232 | A | * | 3/1972 | Voight et al. | 23/300 |
| 3,877,152 | A | | 4/1975 | Gorman | |
| 4,025,795 | A | | 5/1977 | Lackore et al. | |

(Continued)

FOREIGN PATENT DOCUMENTS

CN 2134411 Y 5/1993

(Continued)

OTHER PUBLICATIONS

Saishin Kousui Jijyou (The Aspect of Modern Fragrances) by Ryoichi Komaki Koryo, Japan Perfumery & Flavoring Association, Jun. 2002, vol. 214, supplementary edition, p. 81-94.

(Continued)

*Primary Examiner* — Stephen M. Gravini
(74) *Attorney, Agent, or Firm* — Birch, Stewart, Kolasch & Birch, LLP

(57) ABSTRACT

A washing and drying machine includes a water tank, a rotary drum, an irradiating light source and control means. The rotary drum is rotatably supported in the water tank. The irradiating light source is for emitting a light beam including ultra-violet ray to the inside of the rotary drum. The control means controls the irradiating light source such that the light beam including the ultra-violet ray is emitted to the inside of the rotary drum after the end of the drying process.

6 Claims, 14 Drawing Sheets

U.S. PATENT DOCUMENTS 4,041,614 A * 8/1977 Robinet ..... 34/92
4,057,907 A * 11/1977 Rapino et al. ..... 34/261
4,182,050 A 1/1980 Righi
4,235,562 A * 11/1980 Ribas ..... 405/129.2
4,540,690 A * 9/1985 Szmuszkovicz ..... 514/210.01
4,547,599 A * 10/1985 Schneider et al. ..... 204/158.21
4,557,868 A * 12/1985 Page et al. ..... 540/143
4,619,050 A 10/1986 Klemm
4,652,559 A * 3/1987 Szmuszkovicz ..... 514/210.19
4,752,643 A * 6/1988 Imanishi et al. ..... 528/348
4,839,522 A 6/1989 Bourgeois et al.
4,857,255 A * 8/1989 Imanishi et al. ..... 264/216
4,924,599 A 5/1990 Bubley
5,207,176 A * 5/1993 Morhard et al. ..... 110/246
5,225,170 A 7/1993 Kolk et al.
5,249,255 A 9/1993 Fuqua et al.
5,369,892 A 12/1994 Dhaemers
5,377,427 A 1/1995 Mashata
5,392,529 A 2/1995 Bailey et al.
5,524,358 A 6/1996 Matz
5,546,678 A * 8/1996 Dhaemers ..... 34/275
5,664,340 A * 9/1997 Brown ..... 34/275
5,724,750 A * 3/1998 Burress ..... 34/267
5,732,477 A 3/1998 Toyama
5,766,830 A * 6/1998 Shimizu et al. ..... 430/398
5,787,537 A * 8/1998 Mannillo ..... 8/158
5,953,831 A * 9/1999 Yu ..... 34/269
6,088,932 A * 7/2000 Adamski et al. ..... 34/274
6,185,834 B1 * 2/2001 Yang ..... 34/58
6,207,360 B1 * 3/2001 Ishikawa et al. ..... 430/434
6,223,452 B1 * 5/2001 Hamand ..... 34/267
6,393,725 B1 * 5/2002 Smith et al. ..... 34/260
6,496,280 B2 * 12/2002 Ishikawa et al. ..... 358/1.9
6,653,060 B2 * 11/2003 Nishio ..... 430/488
6,689,421 B2 * 2/2004 Patel et al. ..... 427/245
6,691,536 B2 * 2/2004 Severns et al. ..... 68/12.27
6,877,248 B1 * 4/2005 Cross et al. ..... 34/275
6,898,951 B2 * 5/2005 Severns et al. ..... 68/5 C
7,081,139 B2 * 7/2006 Joerger et al. ..... 8/115.54
7,232,635 B2 * 6/2007 Kobayashi et al. ..... 430/122.1
7,275,400 B2 * 10/2007 Severns et al. ..... 68/18 F
7,517,629 B2 * 4/2009 Kobayashi et al. ..... 430/119.71
7,547,498 B2 * 6/2009 Yamane et al. ..... 430/108.6
7,559,156 B2 * 7/2009 Renzo ..... 34/595
7,614,162 B2 * 11/2009 Renzo ..... 34/603
7,638,583 B2 * 12/2009 Kolich et al. ..... 525/333.3
7,665,227 B2 * 2/2010 Wright et al. ..... 34/339
7,735,345 B2 * 6/2010 Wright et al. ..... 68/13 R
2001/0022663 A1 * 9/2001 Ishikawa et al. ..... 358/1.9
2001/0023014 A1 * 9/2001 Patel et al. ..... 428/195
2001/0026908 A1 * 10/2001 Nishio ..... 430/445
2002/0133886 A1 * 9/2002 Severns et al. ..... 8/142
2003/0017194 A1 * 1/2003 Joerger et al. ..... 424/443
2003/0126691 A1 * 7/2003 Gerlach et al. ..... 8/158
2003/0190547 A1 * 10/2003 Kobayashi et al. ..... 430/125
2004/0058135 A1 * 3/2004 Patel et al. ..... 428/195.1
2004/0129032 A1 * 7/2004 Severns et al. ..... 68/5 C
2005/0050644 A1 * 3/2005 Severns et al. ..... 8/115.51
2005/0084787 A1 * 4/2005 Kobayashi et al. ..... 430/125
2005/0147908 A1 * 7/2005 Yamane et al. ..... 430/108.3
2006/0292311 A1 12/2006 Kilburn et al.
2007/0017115 A1 1/2007 Woolston et al.
2007/0113421 A1 5/2007 Uhara et al.
2007/0142566 A1 * 6/2007 Kolich et al. ..... 525/333.3
2007/0151041 A1 * 7/2007 McAllister et al. ..... 8/149.2
2007/0151129 A1 * 7/2007 McAllister et al. ..... 38/3
2007/0151310 A1 * 7/2007 Wright et al. ..... 68/3 R
2007/0151311 A1 * 7/2007 McAllister et al. ..... 68/3 R
2007/0151312 A1 * 7/2007 Bruce et al. ..... 68/3 R
2007/0163093 A1 * 7/2007 Wright et al. ..... 28/100
2007/0163094 A1 * 7/2007 Wright et al. ..... 28/100
2007/0163095 A1 * 7/2007 McAllister et al. ..... 28/100
2007/0163096 A1 * 7/2007 McAllister et al. ..... 28/100
2007/0163097 A1 * 7/2007 Metcalfe et al. ..... 28/100
2007/0163098 A1 * 7/2007 Tomasi et al. ..... 28/100
2007/0231583 A1 * 10/2007 Ilzuka et al. ..... 428/423.7
2008/0053166 A1 * 3/2008 Lim ..... 68/5 C
2008/0057227 A1 * 3/2008 Suzuki et al. ..... 428/1.1
2009/0208250 A1 * 8/2009 Mitsumori et al. ..... 399/159
2009/0286961 A1 * 11/2009 Tang ..... 530/378
2010/0018262 A1 * 1/2010 Beihoff et al. ..... 68/5 C
2010/0087620 A1 * 4/2010 Kolich et al. ..... 528/392
2010/0136173 A1 * 6/2010 Tang ..... 426/63

FOREIGN PATENT DOCUMENTS

DE 7107935 U 7/1971
DE 27 32 653 A1 1/1979
DE 31 23 899 A1 1/1983
JP 58-117294 U 8/1983
JP 60-164397 U 10/1985
JP 61-90697 A 5/1986
JP 62-261388 A 11/1987
JP 63-005800 A 1/1988
JP 2-12396 U 1/1990
JP 2-57300 A 2/1990
JP 2-82290 U 6/1990
JP 2-146596 U 12/1990
JP 5-46239 B 7/1993
JP 10-043481 A 2/1998
JP 10-244099 A 9/1998
JP 11-123299 A 5/1999
JP 2000-157781 A 6/2000
JP 2002-275756 A 9/2002
JP 2002-285189 A 10/2002
JP 2003-062383 A 3/2003
KR 1994-006252 B1 7/1994
KR 97-39183 U 7/1997
KR 0141547 B1 3/1998
KR 1999-0017741 U 6/1999
KR 2003-0045445 A 6/2003

OTHER PUBLICATIONS

"Research regarding the degradation of the fiver by the ultra-violet rays irradiation of wave length 253.7 nm", Shin-ichirou Hiraide [on-line] [searched May 17, 2004], at <http://www.nagano-it.go.jp/jyouhou/report/2000/0013.pdf>, p. 55-59.
JP 5-131077 Cited in Office Action dated Sep. 23, 2005.
JP 2000-203001 cited in Office Action dated Sep. 23, 2005.
Supplementary European Search Report issued in European Patent Application No. 04820189.1 on May 30, 2012.

* cited by examiner

WASHING AND DRYING MACHINE AND CLOTHES DRYER

This application is a continuation of U.S. patent application Ser. No. 10/582,171 filed on Jun. 8, 2006, now abandoned which is a National Phase of PCT/JP2004/018180 filed on Dec. 7, 2004, which claims priority under 35 U.S.C. §119 (a) to Patent Application No. JP2003-411184(P) filed in Japan on Dec. 10, 2003, to Patent Application No. JP2003-421286 filed in Japan on Dec. 18, 2003 and to Patent Application No. JP2004-190044 filed in Japan on Jun. 28, 2004, all of which are hereby expressly incorporated by reference in their entirety.

BACKGROUND OF THE INVENTION

1. Field of the Invention

The present invention relates to a washing and drying machine and to a clothes dryer. More specifically, according to one aspect, the present invention relates to an improvement of an apparatus for providing fragrance to clothes dried by the washing and drying machine, and according to another aspect, the present invention is directed to a washing and drying machine and a clothes dryer that can provide clothes finished as if they were sun-dried, at the end of the drying step.

2. Description of the Related Art

A clothes dryer drying clothes as an object has been conventionally known. Further, a washing and drying machine that washes and dries clothes in one rotating tank has also been known.

In connection with the one aspect, a clothes dryer having a device for irradiating the clothes with ultra-violet ray has been proposed, as disclosed, for example, in Japanese Patent Laying-Open No. 2-57300. The clothes dryer includes a rotary drum turning the clothes, a circulating path circulating hot air in the drum, and irradiating means for irradiating the inside of the drum with ultra-violet ray, in which the irradiating means irradiates at least in a reduced rate drying step in the process of drying the cloths and in following steps. In the clothes dryer, the ultra-violet ray is emitted from the irradiating means mainly in the reduced rate drying step in which the clothes are almost dry, in the process of drying the clothes. Therefore, ultra-violet ray is not much deactivated by moisture, and hence, it is described that sterilization by the ultra-violet ray from the irradiating means is effectively attained.

In the clothes dryer, however, ultra-violet ray is emitted for sterilization of the clothes, and therefore, it is necessary to irradiate the clothes with ultra-violet ray for a long time at a high temperature. Though highest effect of sterilization can be attained when the clothes are irradiated with ultra-violet ray from before the reduced rate drying step until the end of drying, it is described in this laid-open application that such a manner of irradiation is not very preferable considering damage to the clothes and efficiency of operation.

Further, a washing and drying machine incorporating ultra-violet ray irradiating means for irradiating a textile product with ultra-violet ray to have the textile product with sun-dried fragrance has also been proposed, as disclosed in Japanese Patent Laying-Open No. 2002-275756. In the washing and drying machine, laundry in the rotary tank or textile product to be dried is irradiated with ultra-violet ray to provide sun-dried fragrance with the textile product, and the machine may have draining function as desired, and hot air is introduced as desired, for washing and drying.

Textile product, however, is said to have stronger fragrance at the end of drying if the process described above is performed with the textile product having some moisture. In order to show this effect, this laid-open application describes experimental results obtained by drying wet clothes while emitting ultra-violet ray for a long period of time. When exposed to the ultra-violet ray for a long time, clothes are naturally damaged, which may possibly affect the fragrance.

In connection with another aspect, the principle of aromatizing cloth is described in "SAISHIN KOUSUI JIJYOU" (The Aspect of Modern Fragrances) by Ryoichi KOMAKI, *KORYO*, Japan Perfumery & Flavoring Association, June 2002, Vol. 214, supplementary edition. Here, it is described that volatile components become loose from fibers of sun-dried laundry, because of the functions of ultra-violet ray and radiant heat of sunlight. Specific examples of the volatile components listed in this reference include saturated and unsaturated chain aldehydes with carbon number of 6 to 15 as main components, and ketones, alcohols and some fatty acids.

Japanese Patent Laying-Open No. 2002-285189 discloses a perfume component that recollects washed and dried clean cotton fabric. The inventors of the present invention boiled off odor components of towels, sun-dried the towels and analyzed volatile components emitted from the towels by gas chromatography, and actually, similar substance could be detected.

As described above, however, clothes and washing tank are damaged when the clothes are irradiated with ultra-violet ray. Cotton is decomposed by ultra-violet ray and radiant heat, and mainly, chain hydrocarbons and saturated and unsaturated aldehydes with carbon number of 6 to 15, as well as ketones, alcohols and some fatty acids are isolated therefrom. From a towel that was irradiated by a sterilizing lamp having a peak in UVC wave (by way of example, wavelength=260 nm) for 10 minutes at an adjusted temperature of 40° C., larger amount of volatile substances can be obtained than from a sun-dried towel. From this result, it can be concluded that UVC wave irradiation potentially damages fibers. Sensory analysis also revealed that longer time of irradiation noticeably resulted in odor of a different nature. Therefore, time and temperature control is essential when UVC wave irradiation is employed.

A light source having a peak in UVA wave (by way of example, wavelength=315 to 400 nm), such as a black light or a chemical lamp also causes odor of a different nature from the clothes as in the case of UVC wave, when used for a long time.

According to a further aspect, Japanese Patent Publication No. 5-46239 discloses a clothes dryer including a drum rotatably supported in a main body, an air blower introducing drying air to the drum, a heater for drying an object, a motor driving the drum and the air blower, a ultra-violet ray irradiating lamp provided in the drum, and a detecting device feeding power to the ultra-violet ray irradiating lamp when temperature in the drum rises rapidly in a later stage of the drying process. In the clothes dryer, the object can be dried as the temperature of the rotating tank is increased. This also applies to a washing and drying machine. In order to dry the object more quickly and reliably, the temperature of the rotary tank may be set higher during the drying process. As a result, the temperature of the object in the rotary tank becomes higher than when sun-dried.

When the dried object is taken out from the rotary tank at the end of drying process and the temperature of the object is too high or too low, the sun-dried feeling cannot be enjoyed.

That ultra-violet irradiation of clothes as an object of drying may promote degradation of fibers in the cloths is described in "Research regarding the degradation of the fiver by the ultra-violet rays irradiation of wave length 253.7 nm", Shin-ichirou HIRAIDE [on-line] [searched May 17, 2004], at <http://www.nagano-it.go.jp/jyouhou/report/2000/0013.pdf>.

[Patent Document 1] Japanese Patent Laying-Open No. 2-57300

[Patent Document 2] Japanese Patent Laying-Open No. 2002-275756

[Patent Document 3] Japanese Patent Laying-Open No. 2002-285189

[Patent Document 4] Japanese Patent Publication No. 5-46239

[Non-Patent Document 1] "SAISHIN KOUSUI JIJYOU" (The Aspect of Modern Fragrances) by Ryoichi KOMAKI, KORYO, Japan Perfumery & Flavoring Association, June 2002, Vol. 214, supplementary edition

[Non-Patent Document 2] "Research regarding the degradation of the fiver by the ultra-violet rays irradiation of wave length 253.7 nm", Shin-ichirou HIRAIDE [on-line] [searched May 17, 2004], at <http://www.nagano-it.go.jp/jyouhou/report/2000/0013.pdf>.

SUMMARY OF THE INVENTION

Problems to be Solved by the Invention

An object of the present invention is to provide a washing and drying machine that can suppress degradation of clothes and add sun-dried fragrance to the clothes.

Another object of the present invention is to provide a washing and drying machine and a clothes dryer that realize almost-sun-dried feeling at the end of the drying step.

Means for Solving the Problems

According to one aspect, the washing and drying machine of the present invention includes a water tank, a rotary drum, irradiating means and control means. The rotary drum is rotatably supported in the water tank. The irradiating means is for emitting a light beam including ultra-violet ray to the inside of the rotary drum. The control means controls the irradiating means such that the light beam including the ultra-violet ray is emitted to the inside of the rotary drum after the end of the drying process.

In this aspect, after the end of the drying process, the light beam including the ultra-violet ray is emitted to the inside of the rotary drum. Therefore, the object of washing that is dried in the rotary drum can be irradiated with ultra-violet ray under the best temperature condition to provide near sun-dried fragrance without being degraded. Thus, when the clothes are taken out from the washing and drying machine, the very fragrance of sun-dried clothes can be enjoyed.

In this aspect, the control means preferably controls the irradiating means such that only the irradiating step of irradiating the inside of the rotary drum with the light beam including the ultra-violet ray can be performed. In that case, by putting dry clothes or textile product that is not usually washed in the rotary drum, it is possible to add the sun-dried-like fragrance to the clothes or the like.

In this aspect, preferably, the control means controls the irradiating means such that the irradiating step of irradiating the inside of the rotary drum with the light beam including the ultra-violet ray is performed when the temperature in the rotary drum is not lower than 30° C. and not higher than 60° C. To realize the aroma and feeling that are close to those attained by sun-drying, it is important to control temperature in the irradiating step to attain slightly warm temperature. If the temperature is too low, the warm, comfortable feeling cannot be enjoyed, though the irradiated clothes have the fragrance. If the temperature is too high, the volatile fragrance would be lost, and the fragrance cannot be enjoyed when the clothes are taken out from the washing and drying machine. By irradiating the clothes in the rotary drum with the light beam including ultra-violet ray while the temperature of the rotary drum is controlled to be not lower than 30° C. and not higher than 60° C., sun-dried-like fragrance and comfortable warm feeling can be attained.

Further, in this aspect, preferably, the control means controls a door, provided to open/close an opening of the rotary drum, such that the door is closed during the irradiating step of irradiating the inside of the rotary drum with the light beam including the ultra-violet ray. This prevents the user or any person or object near the washing and drying machine from being exposed to the ultra-violet ray.

In this aspect, preferably, the component includes a ultra-violet ray absorber, and is formed to shut the ultra-violet ray. This prevents degradation of the component by the ultra-violet ray, and leakage of ultra-violet ray from the main body of the washing and drying machine to the outside is prevented. Therefore, undesirable influence to the user or any person or object near the washing and drying machine can be prevented.

In this aspect, preferably, the irradiating means is provided on a door for opening/closing the opening of the rotary drum. By this arrangement, the irradiating means is provided such that irradiation therefrom is directed to the inside of the rotary drum when the door is closed. Therefore, by the joint control with door lock, it is possible to effectively prevent the user or any person or object near the washing and drying machine from being exposed to the ultra-violet ray.

In this aspect, preferably, the irradiating means may be provided on the water tank to emit a light beam including the ultra-violet ray to an outer circumferential wall surface of the rotary drum, and the outer circumferential wall surface of the drum may have a plurality of through holes penetrating to the inside of the rotary drum. Thus, assuming that a light source covering a wide wavelength range from visible light to infrared ray is used as the irradiating means, even when the outer circumferential surface of the rotary drum is heated by the heat ray emitted from the light source, the clothes are not locally and directly heated by the heat ray. As the clothes are irradiated directly by the light leaking from the plurality of through holes reaching the inside of the rotary drum, the sun-dried-like fragrance can be added to the object dried in the rotary drum.

According to another aspect, the washing and drying machine of the present invention includes a washing tank for accommodating clothes, and irradiating means for emitting light not including the ultra-violet ray to the inside of the washing tank.

As the light not including ultra-violet ray is emitted, a washing and drying machine can be provided in which degradation of clothes caused by ultra-violet ray can be prevented, while the sun-dried-like fragrance can be added to the clothes.

In this aspect, preferably, the irradiating means includes a light source emitting light having the wavelength of 400 nm or longer. Here, as the light having the wavelength of 400 nm or longer is used, irradiation of the washing tank with ultra-violet ray can be prevented.

In this aspect, preferably, the irradiating means includes a light source, and ultra-violet ray shutting means for shutting out the ultra-violet ray. Here, a light source including ultra-violet ray having the wavelength shorter than 400 nm may be used, and even in that case, irradiation of the washing tank with ultra-violet ray can be prevented.

In this aspect, preferably, the light source is a halogen lamp. Here, the halogen lamp with much temperature radiation is used as the light source, and as a result, generation of volatile substance is promoted and the good fragrance can be added efficiently.

In this aspect, preferably, the washing and drying machine further includes drying means for feeding hot air to the washing tank, temperature detecting means for detecting temperature in the washing tank, and control means for controlling the irradiating means such that light is emitted when the temperature detected by the temperature detecting means is not lower than 40° C. and lower than 70° C. Here, the temperature in the washing tank is controlled to be not lower than 40° C. and lower than 70° C. when the irradiating means is used. As a result, good fragrance can be added efficiently.

In this aspect, preferably, the control means controls the irradiating means such that the clothes in the washing tank is irradiated with light after the clothes are dried by the drying means. Here, the clothes are irradiated with light after the end of drying process. As a result, good fragrance is added after the end of drying and immediately before taking out the clothes, and fresh aroma can be enjoyed.

In this aspect, preferably, the washing and drying machine further includes door lock means for locking the door, provided at an inlet for inputting clothes into the washing tank, in a closed state, and control means activates the door lock means while the irradiating means irradiates. Here, the door is locked while the irradiating means is used. As a result, it becomes possible to prevent any person near the washing and drying machine from burning or injury by the light beam or hot air.

According to a further aspect, the washing and drying machine of the present invention is capable of performing at least one of washing process and drying process, and includes a main body, a water tank provided in the main body, a drum provided in the water tank for accommodating an object of washing/drying, a motor for rotating the drum, a drain path for draining water in the drum to the outside of the main body, a door portion on an opening of the drum in the main body, heating means for heating the inside of the drum with the door portion closed, ultra-violet ray irradiating means for emitting ultra-violet ray to the inside of the drum, and a control means controlling the heating means such that temperature in the drum is within a prescribed temperature range when the dried object is taken out after the end of the drying process.

Because of the above-described arrangement, sun-dried-like feeling can be attained after the end of drying process.

In this aspect, preferably the prescribed temperature range is not lower than 40° C. and not higher than 60° C. By this setting, almost sun-dried feeling can be attained.

In this aspect, preferably, the drying process includes a step of irradiating with ultra-violet ray from the ultra-violet ray irradiating means. Further, at least a part of the step of irradiating with ultra-violet ray from the ultra-violet ray irradiating means may be performed simultaneously with at least a part of the heating step by the heating means. In this case, as the step of ultra-violet ray irradiation is performed during drying, the time extension caused by the irradiating step can be reduced.

In this aspect, preferably, the wavelength of the ultra-violet ray emitted from ultra-violet ray irradiating means is at least 280 nm. This suppresses degradation of the object of drying.

In this aspect, preferably, the washing and drying machine further includes input means for controlling ON/OFF of the ultra-violet ray irradiating means. This enables the user to selectively turning ON/OFF the ultra-violet ray irradiating means.

In this aspect, preferably, a ultra-violet absorber absorbing the ultra-violet ray is arranged to surround the drum. This prevents leakage of the ultra-violet ray to the outside of the main body.

The clothes dryer in accordance with the present invention is capable of performing a drying process for drying clothes, and it includes a main body, a drum provided in the main body for accommodating an object of drying, a motor for rotating the drum, a door portion on an opening of the drum in the main body, heating means for heating the inside of the drum with the door portion closed, ultra-violet ray irradiating means for emitting ultra-violet ray to the inside of the drum, and a control means controlling the heating means such that the temperature in the drum is within a prescribed temperature range when the dried object is taken out after the end of the drying process.

Because of this arrangement, sun-dried-like feeling can be attained at the end of the drying process.

Effects of the Invention

As described above, according to one aspect of the present invention, degradation of clothes can be prevented and fragrance close to that attained by sun-drying can be added to the clothes. According to another aspect, the sun-dried-like fragrance can be enjoyed when clothes are taken out from the washing and drying machine and from the clothes dryer.

DESCRIPTION OF THE REFERENCE CHARACTERS

1 main body, 2 water tank, 3 rotary drum, 6 clothes, 7 door unit, 20 light irradiating unit, 21 irradiating light source, 22 reflector, 23 heat-resistant glass plate, 32 small hole, 100, 200, 1100, 1100A, 2100, 2200, 2300 washing and drying machine, 101 irradiating light source, 101A light, 102 reflector, 103 light irradiating unit, 103A heat-resistant protective glass, 104 air heater, 105 circulating fan, 106 washing tank, 106B small hole, 107 water tank, 108 cooler, 109 motor, 110 baffle, 111 drain pump, 112 laundry, 113 door unit, 113A door glass, 113B front door, 114 drain hose, 115 cooling water inlet, 120 microcomputer, 130 temperature sensor, 140 door lock, 201 main body, 202 water tank, 203 rotary drum, 203A small hole, 203B, 221A temperature sensor, 204 motor, 205 baffle, 206 clothes, 207 door unit, 207A door lock device, 208 dehumidifying unit, 209 circulating fan, 210 heater (for heating air), 211 drain pump, 212 drain hose, 212A drain pipe, 213 cooling water inlet, 214 control means, 220 irradiating unit, 221 irradiating light source, 222 reflector, 223 blower fan, 224 heat-resistant glass, 231 open/close door, 232 control portion, 233 operation panel, 234 suspending device, 235 tank shaft, 236 bearing, 237 pulsator, 238 pulsator shaft, 239 balancer, 240 exhaust duct, 241 hot air supply path, 242 hot air supply hose, 243 drain valve, 271 door glass, 272 door front portion, 273 air inlet/outlet hole.

DETAILED DESCRIPTION OF THE INVENTION

In the following, embodiments of the washing and drying machine and clothes drier of the present invention will be described.

First Embodiment

Figure 1:
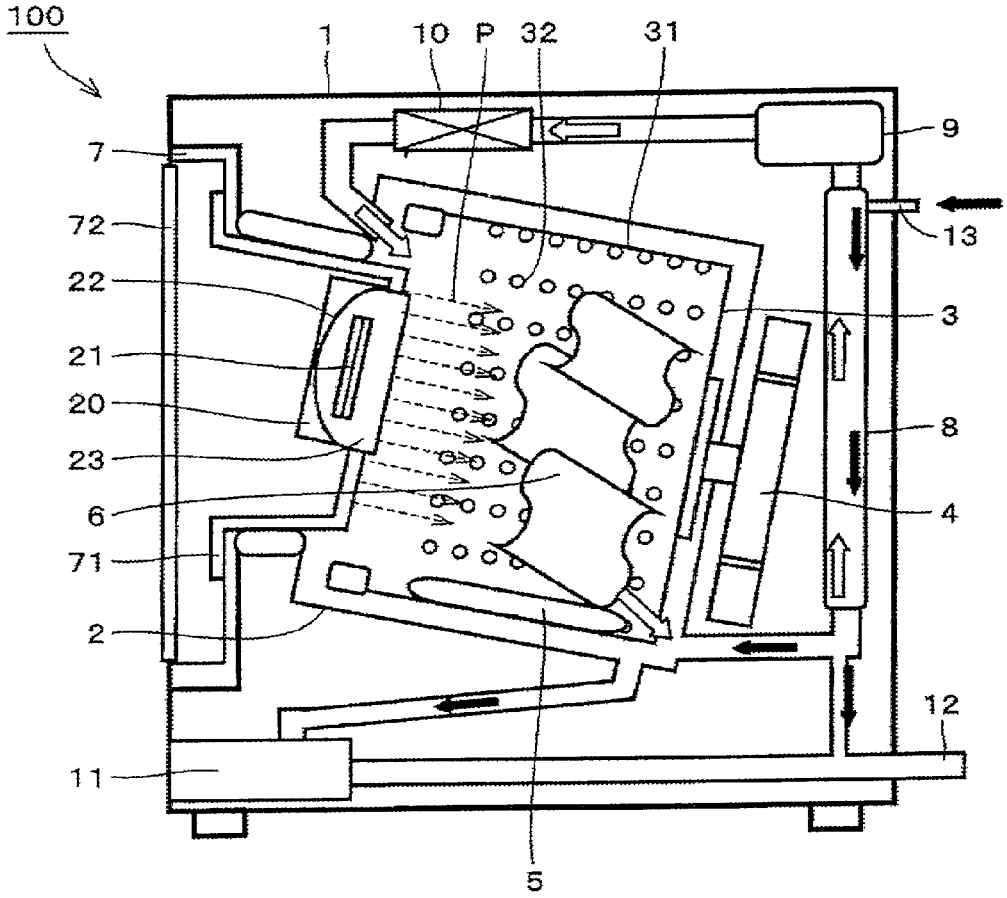
FIG. 1 is a cross-sectional side view representing a schematic structure of a washing and drying machine in accordance with a first embodiment of the present invention.

FIG. 1 is a cross-sectional side view representing a schematic structure of a washing and drying machine in accordance with a first embodiment. As shown in FIG. 1, a washing and drying machine 100 includes a main body 1, a water tank 2 provided in main body 1 and a rotary drum 3 rotatably supported in water tank 2.

At the bottom of rotary drum 3, a rotating mechanism portion is provided for rotating rotary drum 3 forward and backward by means of a motor 4. A baffle 5 for tumbling clothes in rotary drum 3 is mounted on an inner circumferential wall surface of rotary drum 3. Further, on an outer circumferential wall surface of rotary drum 3, a number of small through holes 32 are formed, reaching the inside of rotary drum 3, to enable passage of water in rotary drum therethrough for spin-drying the clothes 6. A door unit 7 is provided to open/close the opining of rotary drum 3, for putting in and taking out clothes and for keeping the drum air-tight and water-tight. Door unit 7 includes a door glass 71 provided so that the condition of clothes 6 is visible from the outside, and a front door 72 having micro capsules containing ultra-violet absorber adhered on the entire surface, or a front door 72 formed of a material having the ultra-violet absorber kneaded therein.

The drying apparatus includes a circulating fan 9 and an air heater 10. Air heater 10 heats air. Circulating fan 9 circulates air heated by air heater 10 for evaporating and removing water from the clothes, through a path communicating the inside of water tank 2, rotary drum 3 and a cooler 8.

Light irradiating unit 20 includes an irradiating light source 21 for emitting a light beam including ultra-violet ray, which is mounted on door unit 7 so that the light beam can be emitted in a direction represented by an arrow P directly to clothes 6 in rotary drum 3. Light irradiating unit 20 is provided with a reflector 22 for reflecting the light emitted from irradiating light source 21 in a direction from the opening to the bottom wall surface of rotary drum 3. Further, light irradiating unit 20 is provided with a heat-resistant glass plate 23 having high light transmittance, to protect irradiating light source 21 from washing water and water resulting from spin-drying. Light irradiating unit 20 is fixed on door unit 7 or on door glass 71 such that reflector 22 is on the backside and heat-resistant glass plate 23 is tightly adhered to door unit 7 or door glass 71. Specifically, light irradiating unit 20 is fixed on door unit 7, with door unit 7 or door glass 71 being sealed with heat-resistant glass plate 23 by means of a sealing member or adhesive having heat-resistance (heat insulation) and water-resistance.

Washing and drying machine 100 includes a control device (not shown) as control means for controlling light irradiating light source 21 as the irradiating means structured as described above. Control device controls irradiating light source 21 such that the light beam including ultra-violet ray is emitted to the inside of rotary drum 3 after the end of drying process. Preferably, the control device controls irradiating light source 21 such that only the irradiating step of emitting the light beam including ultra-violet ray to the inside of rotary drum 3 can be performed. More preferably, the control device controls irradiating light source 21 such that the light beam including ultra-violet ray is emitted to the inside of rotary drum 3 when the temperature in rotary drum is not lower than 30° C. and not higher than 60° C. More preferably, the control device controls door unit 7 provided to open/close the opening of rotary drum 3 such that the door unit is locked in the irradiating step in which the light beam including ultra-violet ray is emitted to the inside of rotary drum 3.

The washing and drying machine of the present embodiment having the above-described structure operates in the following manner.

In response to a signal from the control means, not shown, motor 4 is rotated forward/backward, so that rotary drum 3 directly connected to motor 4 is also rotated forward/backward. By the rotation, baffle 5 provided fixed on the inner circumferential surface of rotary drum 3 repeats an operation of bringing clothes 6 up and down, whereby the washing step is performed. In this manner, clothes are washed utilizing the so-called tumble-wash effect.

At the end of the washing step, drain pump 11 is driven so that the water in water tank 2 is discharged through drain hose 12. Then, the operation proceeds to rinsing and spin-drying steps, and the washing process ends.

Next, the operation in the drying process will be described.

After the end of the washing process, the drying process starts. When the drying operation starts, rotary drum 3 rotates forward/backward, and clothes 6 are moved up and down, causing the turning effect, while power is fed to circulating fan 9 and air heater 10, so that the air temperature increases. Water is evaporated from the clothes heated by the hot air and enters cooler 8. To cooler 8, cooling water has been supplied from a cooling water inlet 13 provided opposing thereto at an upper portion, so that the evaporated water is cooled and condensed. The condensed water then flows to drain pump 11, mixed with the cooling water and discharged. The dehumidified air is fed back to air heater 10 and heated. The heated air enters rotary drum 3, heats clothes 6 and evaporates water from clothes 6. By the repetition of this operation, clothes 6 are dried. The heat source used in the drying process is air heater 10. Generally, air heater 10 is provided in an air circulating duct, and a sheathed heater having a resistance-heating wire covered with metal is used therefor.

In FIG. 1, white arrows represent the "air circulating path," and black arrows represent the "cooling water path."

After drying of clothes 6 in this manner ends, that is, when the steps of pre-heating, constant rate drying, reduced rate drying are completed, drying operation ends (air heater 10 is turned off) and cool down step is performed, locked state of door unit 7 at the opening of rotary drum 3 is detected by the control device, and a light beam including ultra-violet ray is emitted from irradiating light source 21 in the direction represented by the arrow P to dried clothed 6 in rotary drum 3, with the temperature in drum 3 controlled to be not lower than 30° C. and not higher than 60° C. The time of irradiation may be adjusted within the range of 5 minutes to 2 hours, dependent on the temperature in rotary drum 3. Preferably, the irradiation time should be longer at a lower temperature and shorter at a higher temperature. When the temperature is not lower than 40° C. and not higher than 60° C., preferable time is about 5 minutes to 1 hour.

In this manner, the light beam including ultra-violet ray is emitted to rotary drum 3 after the end of drying process, and therefore, ultra-violet ray irradiation can be performed at the optimal temperature condition to add sun-dried-like fragrance to the object of washing dried in rotary drum, without damaging clothes 6. Thus, when clothes 6 are taken out from washing and drying machine 100, the very fragrance of sun-dried laundry can be enjoyed.

To realize the aroma and feeling that are close to those attained by sun-drying, it is important to control temperature in the irradiating step to attain slightly warm temperature. If the temperature is too low, the warm, comfortable feeling cannot be enjoyed, though the irradiated clothes have the fragrance. If the temperature is too high, the volatile fragrance would be lost, and the fragrance cannot be enjoyed when the clothes are taken out from the washing and drying machine. By irradiating the clothes in the rotary drum with the light beam including ultra-violet ray while the temperature of the rotary drum is controlled between 30° C. and 60° C., sun-dried-like fragrance and comfortable warm feeling can be attained.

Conventionally, the door unit of a washing and drying machine has the door lock function in order to prevent leakage of water when water level in the water tank exceeds a prescribed value, to prevent possible injury during high speed rotation, or to prevent burning when the temperature inside the rotary drum exceeds a prescribed value during drying process. In washing and drying machine 100 of the present embodiment, when the irradiating step of emitting the light beam including ultra-violet ray to rotary drum 3 is to be performed, control device controls door unit 7 for opening/closing the opening of rotary drum 3 so that the door unit is locked. This prevents the user or person or objects near the washing and drying machine from being exposed to the ultra-violet ray.

In this manner, the door is locked also in the irradiating step to prevent the influence of ultra-violet ray on the user. It is noted, however, that when the user temporarily suspends operation, irradiating light source 21 is controlled to stop irradiation and air heater 10 is controlled to be off, and therefore, the door can be unlocked. In that case, turning off of the irradiating means and turning off of the light source are detected, and then, the control device unlocks the door unit 7.

As to the technique applied to components of washing and drying machine 100 such as water tank 2 to shut off ultra-violet ray, similar technique applied to front door 72 is adopted. Namely, micro capsules containing ultra-violet absorber may be adhered on the entire surface of the component, or the component may be formed of a material having the ultra-violet absorber kneaded therein. This prevents degradation of the components such as water tank 2 by the ultra-violet ray, and as the leakage of ultra-violet ray to the outside of washing and drying machine 100 is prevented, undesirable influence to any person or object near the washing and drying machine can be prevented.

In washing and drying machine 100 of the present embodiment, irradiating light source 21 is mounted on door unit 7 provided to open/close the opening of rotary drum 3. Namely, irradiating light source 21 can be arranged such that the emission from irradiating light source 21 is directed to the inside of rotary drum 3 when door unit 7 is closed. Therefore, by the joint control by the control device detecting the state of door lock of door unit 7, it is possible to effectively prevent the user or any person or object near the washing and drying machine from being exposed to the ultra-violet ray.

The position of mounting light irradiating unit 20 including irradiating light source 21 is not limited on door unit 7. The light irradiating unit 20 may be provided to emit the light beam to the outer circumferential surface, rather than from the opening to the bottom wall surface of rotary drum 3 to irradiate the clothes 6.

Figure 2:
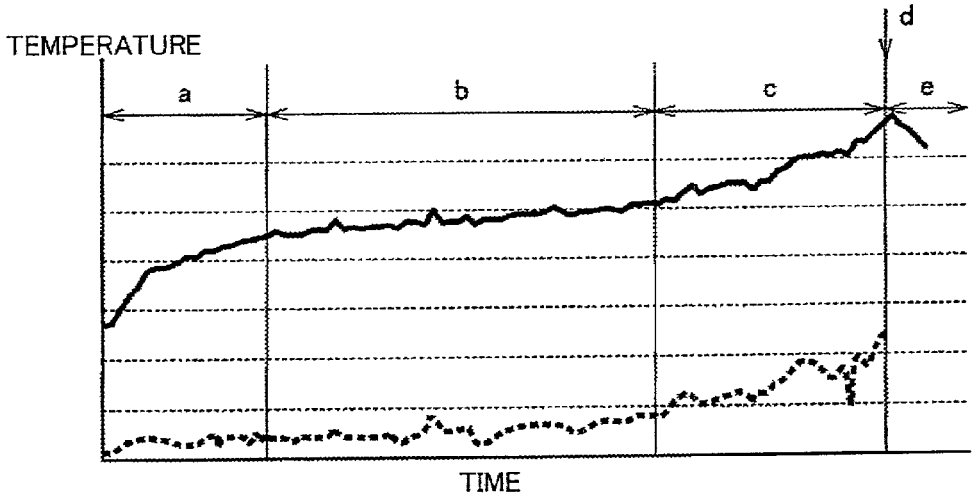
FIG. 2 represents temperature data measured as an experimental result of drying operation by the washing and drying machine shown in FIG. 1.

FIG. 2 shows temperature data measured as an experimental result of drying operation performed by using washing and drying machine 100 shown in FIG. 1. The solid line represents the temperature of air exhausted from rotary drum 3, and the dotted line represents difference between the temperature of air exhausted from rotary drum 3 and the temperature of cooling water. The drying process is typically divided into preheat drying step a, constant rate drying step b, and reduced rate drying step c. At the end point d of drying determined by end-detection, cool down step e is performed in which air heater 10 is turned off so that the user can safely take out clothes 6. It is often the case that the temperature of the air exhausted from rotary drum 3 is still as hot as 60° C. or higher. Therefore, there may be cases where irradiation of clothes 6 with the light beam from irradiating light source 21 is not preferable during the drying process or in the cool down step, in order to attain sun-dried-like fragrance and comfortable feeling.

To confirm this idea, sensory analysis of fragrance of cotton towel irradiated with the light beam from a bactericidal lamp was conducted, with temperature and time varied, of which result is shown in Table 1.

TABLE 1

| | temp. | 5 min. | 10 min. | 30 min. |
|---|---|---|---|---|
| bactericidal lamp | 30° C. | + | + | + |
| bactericidal lamp | 40° C. | +++ | +++ | Δ |
| bactericidal lamp | 50° C. | +++ | Δ | |
| bactericidal lamp | 60° C. | +++ | Δ | |

The light beam emitted from the bactericidal lamp had peak intensity at the wavelength of about 260 nm, and for convenience of experiment, the lamp used had an output of 15 W. It is noted, however, that a black light that emits a light beam having a peak intensity at the wavelength of 300 nm or longer or an insect catching lamp may be used, or a small size lamp having the output of about 4 W may be used, as the lamp actually mounted in the washing and drying machine.

In Table 1 showing the result of sensory analysis, the mark + represents fragrance attained when dried outdoors, +++ represents comfortable fragrance close to that attained by sun-drying, and Δ represents a slightly spicy fragrance. From the results, it can be understood that when the temperature is 30° C., though the fragrance of outdoor-drying can be attained, it is somewhat unsatisfactory. When the temperature is 60° C., though the fragrance can be attained in a short period of time, some spicy or smoky fragrance also generates in a relatively short period of time. Therefore, we can conclude that preferable temperature range for irradiation is between 30° C. and 60° C. The same applies to cases using a black light or an insect catching light, with the time necessary to attain the sun-dried-like fragrance being longer (30 minutes to 1 hour), and the time to attain some spicy fragrance being longer (2 to 3 hours).

Based on the results described above, it can be seen that during the drying process and the cool down step, it is impossible to maintain rotary drum 3 in the optimal temperature range (30° C. to 60° C.) to attain the comfortable fragrance of sun-drying. Therefore, in the present embodiment, irradiating step is provided in which rotary drum 3 is kept in the optimal temperature range (30° C. to 60° C.) after cool down and the light beam is emitted, whereby the comfort of sun-drying can be realized by emitting the light beam including ultra-violet ray for a short period of time after the end of drying.

Second Embodiment

Figure 3:
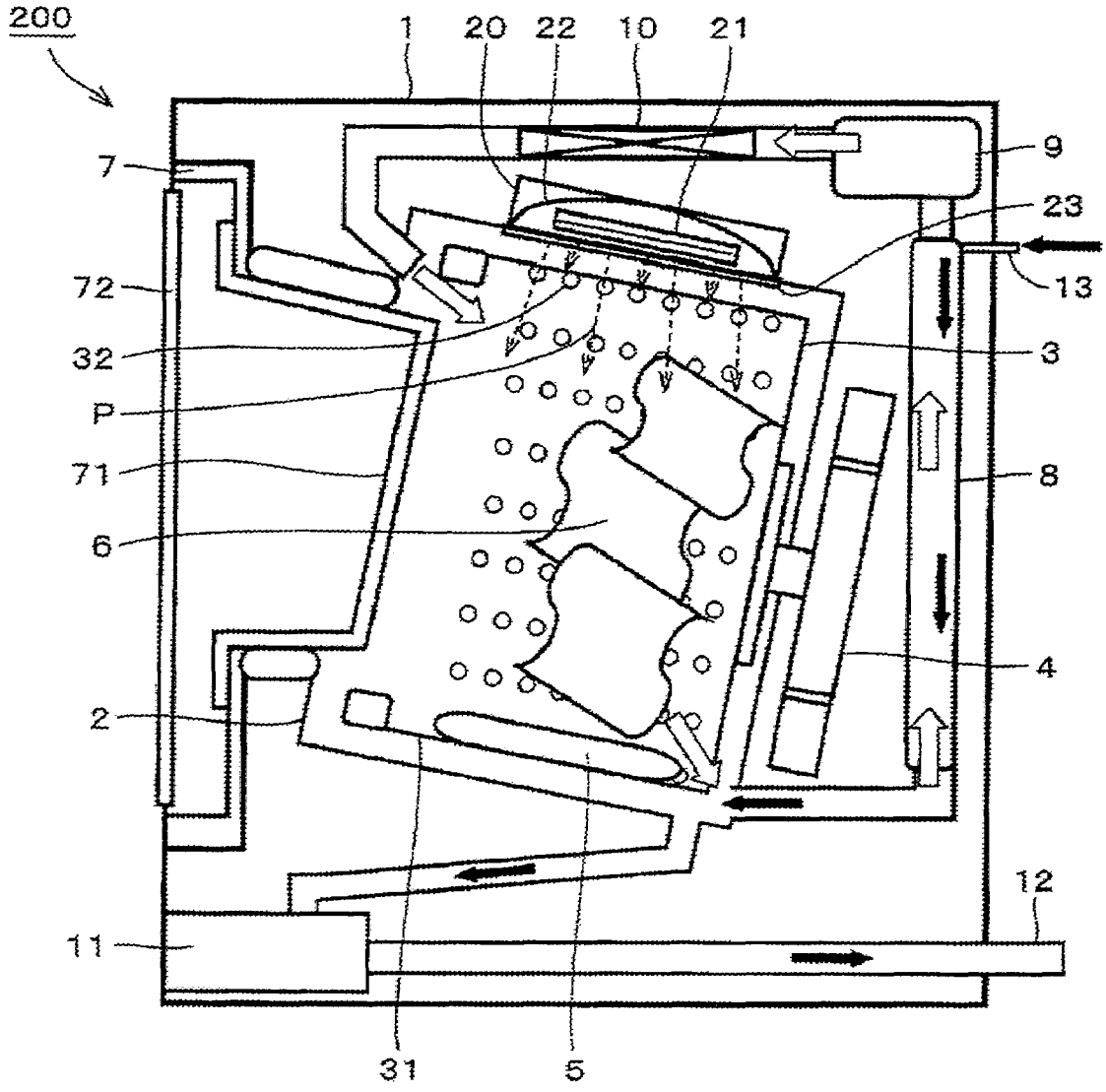
FIG. 3 is a cross-sectional side view representing a schematic structure of a washing and drying machine in accordance with a second embodiment of the present invention.

FIG. 3 is a cross-sectional side view representing a schematic structure of a washing and drying machine in accordance with a second embodiment of the present invention.

A washing and drying machine 200 in accordance with the present embodiment is a modification of washing and drying machine 100 of the first embodiment.

When irradiating light source 21 emits a light beam covering the wavelength range from visible light to infrared ray, it means that irradiating light source 21 also emits heat wave. Therefore, it is possible that clothes 6 at a position close to light irradiating unit 20 are locally heated in washing and drying machine 100 shown in FIG. 1. In order to solve this problem, in washing and drying machine 200 having the main structure similar to that shown in FIG. 1, light irradiating unit 20 is mounted on water tank 2, as shown in FIG. 3. Light irradiating unit 20 includes an irradiating light source 21 for emitting a light beam including ultra-violet ray, which is mounted on water tank 2 so that the light beam can be emitted in a direction represented by an arrow P directly to clothes 6 in rotary drum 3. On an outer circumferential wall surface of rotary drum 3, a number of small through holes 32 are formed, reaching the inside of rotary drum 3, enabling the light beams emitted from irradiating light source 21 to pass therethrough to irradiate clothes 6. Light irradiating unit 20 is provided with a reflector 22 for reflecting the light emitted from irradiating light source 21 in a direction to the outer circumferential wall surface of rotary drum 3. Further, light irradiating unit 20 is provided with a heat-resistant glass plate 23 having high light transmittance, to protect irradiating light source 21 from washing water and water resulting from spin-drying. Light irradiating unit 20 is fixed on the outer circumferential wall surface of water tank 2 such that reflector 22 is on the backside, and heat-resistant glass plate 23 is tightly adhered to the outer circumferential wall surface of water tank 2. Specifically, light irradiating unit 20 is fixed on the outer circumferential wall surface of water tank 2 by means of a screw or the like, with the water tank 2 sealed with heat-resistant glass plate 23 by means of a sealing member or adhesive having heat-resistance (heat insulation) and water-resistance.

When light irradiating unit 20 structured as described above is turned on, the outer circumferential wall surface of rotary drum 3 is heated and clothes 6 are directly irradiated with light beams that leaked through large number of small through holes 32 opened in the outer circumferential wall surface of rotary drum 3 to reach the inside. As a result, it becomes possible to add sun-dried-like fragrance to clothes 6 dried in rotary drum 3.

In the washing and drying machine described above, the control device may control irradiating light source 21 such that only the irradiating step of emitting the light beam including ultra-violet ray to the inside of rotary drum 3 can be performed. In that case, by putting dry clothes or textile product that is not usually washed in the rotary drum 3, it is possible to add the sun-dried-like fragrance to the clothes or the like.

Figure 4A:
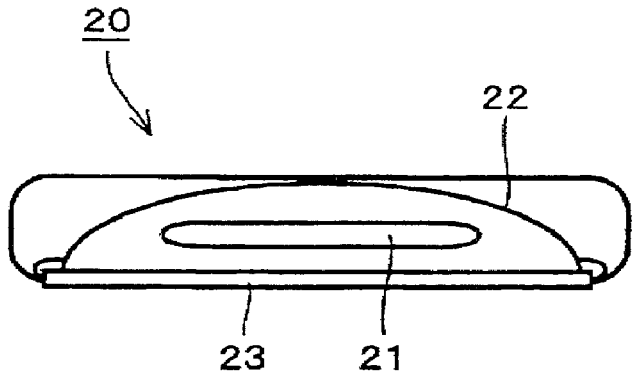
FIG. 4A is a schematic cross-sectional side view representing an exemplary structure of a light irradiating unit.
Figure 4B:
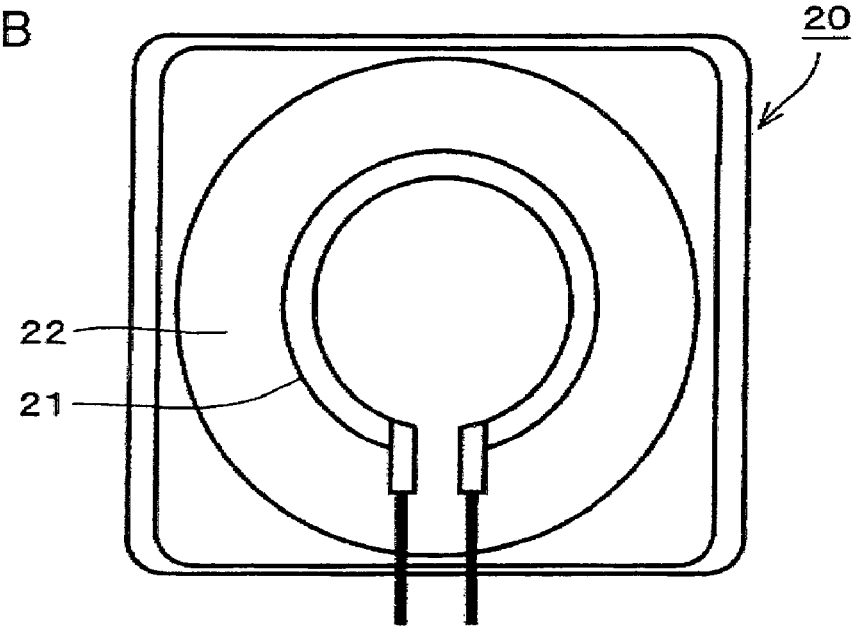
FIG. 4B is a schematic front view representing an exemplary structure of a light irradiating unit.

FIGS. 4A and 4B are a cross-sectional side view (FIG. 4A) and a front view (FIG. 4B) schematically showing an exemplary structure of light irradiating unit 20. The front view (FIG. 4B) shows the unit with heat-resistant glass plate 23 removed.

As shown in FIGS. 4A and 4B, on the back surface of irradiating light source 21, a reflector 22 having high light reflectance is provided, and on a light irradiating surface, a heat-resistant glass plate 23 having high light transmittance is provided. Irradiating light source 21 is covered with heat-resistant glass plate 23, and the housing of light irradiating unit 20 is formed of a water-resistant metal case. The water-resistant case may be formed of a general metal plate such as stainless-steel or galvanized steel plate. Namely, light irradiating unit 20 is implemented as a water-resistant unit that can shut off water scattered during washing, rinsing and spin-drying steps. Though irradiating light source 21 has a ring-shape in the exemplary structure shown in FIGS. 4A and 4B, a straight, tube-shaped one may be used to reduce mounting area. Aluminum is the most preferable material for reflector 22 as it hardly absorbs light. Alternatively, stainless-steel or the like with metallic luster may be used. As for the material of heat-resistant glass plate 23, any material having high heat-resistance and thermal-shock-resistance may be used, and crystalline glass is preferable.

In the present embodiment, descriptions of portions similar to those of the first embodiment will not be repeated.

Third Embodiment

Figure 5:
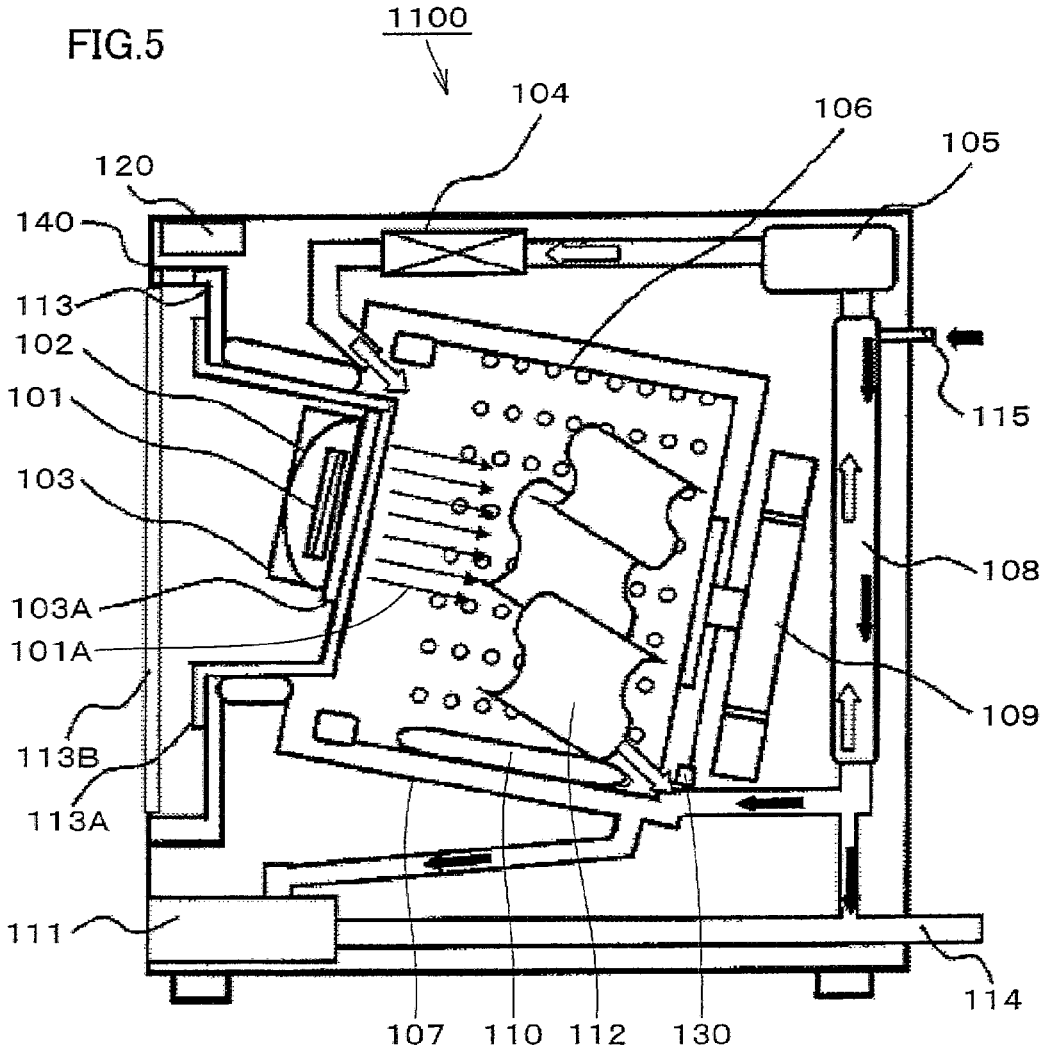
FIG. 5 is a cross-sectional side view representing a schematic structure of a washing and drying machine in accordance with a third embodiment of the present invention.

FIG. 5 is a cross-sectional side view representing a schematic structure of a drum type washing and drying machine in accordance with a third embodiment of the present invention. Referring to FIG. 5, a washing and drying machine 1100 includes a microcomputer (hereinafter referred to as "micon") 120 controlling various operations of the washing and drying machine. Washing and drying machine 1100 includes a water tank 107, a motor 109, a washing tank 106 coupled to the motor and supported rotatably, a rotary mechanism for rotating washing tank 106 forward/backward by motor 109, a baffle 110 mounted in washing tank 106 for turning the laundry, an air-tight and water-tight door unit 113 for putting in and taking out clothes 112, and a door lock 140 locking the door unit in the closed state.

Door unit 113 includes a light irradiating unit 103, a door glass 113A provided so that the condition of clothes 112 is visible from the outside, and a front door 113B.

Further, light irradiating unit 103 includes a reflector 102 and a heat-resistant protective glass 103A: Reflector 102 reflects light emitted from irradiating light source 101 to the side of washing tank 106, and prevents leakage of ultra-violet ray to the outside. Heat-resistant protective glass 103A has a characteristic that well absorbs only the ultra-violet ray component of the light beam (high ultra-violet shielding and absorbing characteristics). Further, heat-resistant protective glass 103A protects irradiating light source 101 from washing water and water resulting from spin-drying.

Figure 6:
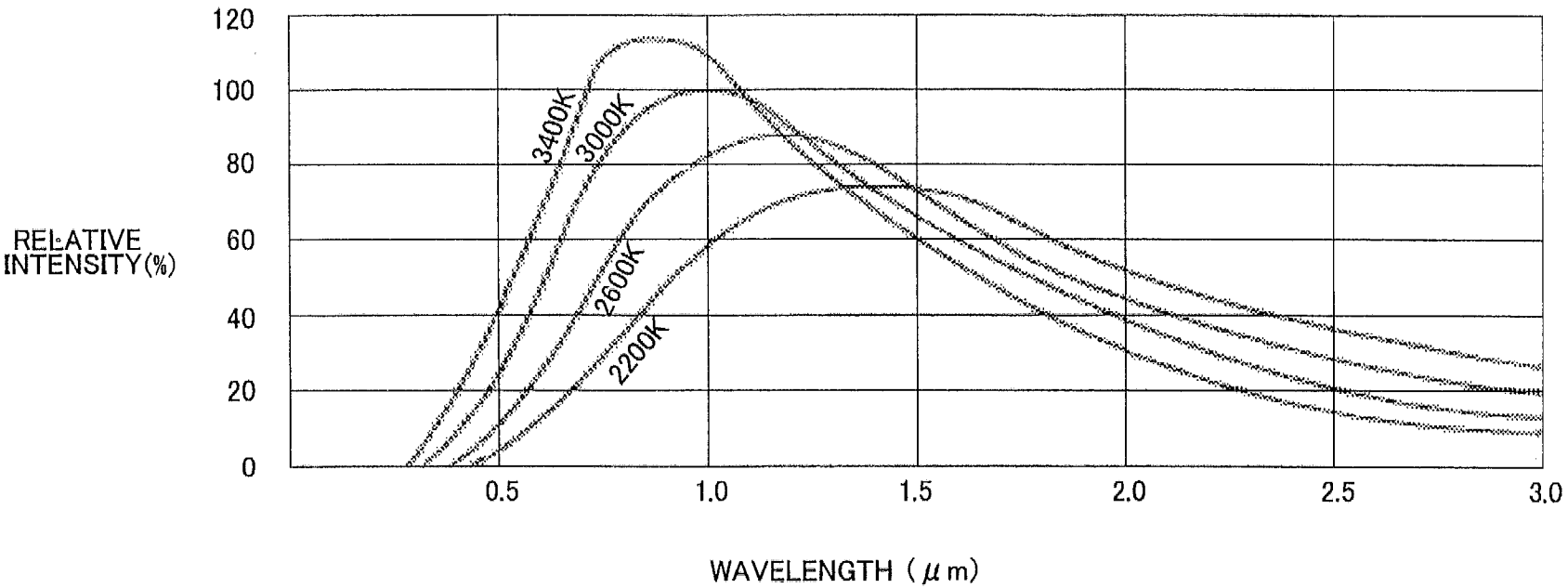
FIG. 6 shows an example of spectral distribution characteristic of a halogen lamp used in the washing and drying machine shown in FIG. 5.
Figure 7:
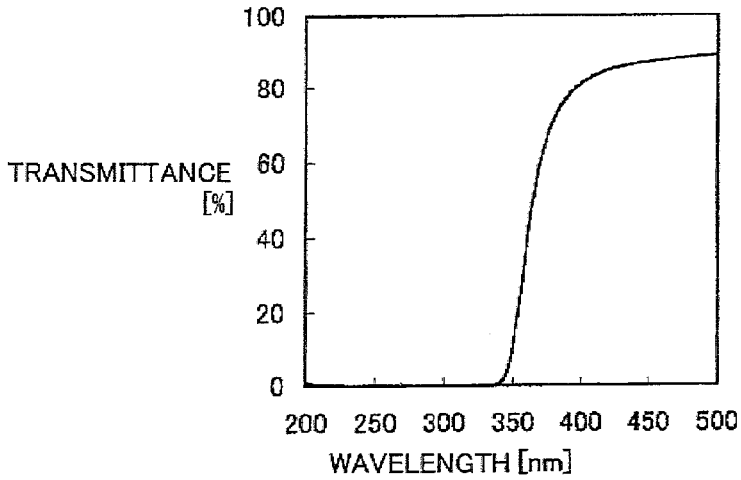
FIG. 7 represents transmittance of a heat-resistant protective glass.

In the present embodiment, a halogen lamp having color temperature of 2200K is used as irradiating light source 101. FIG. 6 shows a spectral distribution characteristic of the halogen lamp used in the washing and drying machine in accordance with the present embodiment. Referring to FIG. 6, intensity of light provided by 2200K halogen lamp having the wavelength not longer than 400 nm is weak. FIG. 7 represents transmittance of the heat-resistant protective glass 103A. Referring to FIG. 7, heat-resistant protective glass 103A absorbs ultra-violet ray and reduces transmittance. Transmittance of light having the wavelength of 400 nm or shorter decreases significantly, and light having the wavelength of 340 nm or shorter is hardly transmitted. The above-described halogen lamp having the color temperature of 2200K and heat-resistant protective glass 103A were used in combination, and irradiation intensity was measured at a distance of 50 cm. As a result, irradiation intensity in the ultra-violet range of 10 to 400 nm wavelength was 0.00 mW/cm$^2$, that is, ultra-violet ray could not be detected. The inventors found that when a towel was irradiated with the unit, volatile substances similar to those obtained by sun-drying such as saturated and unsaturated chain aldehydes with carbon number of 6-15 as main components, and ketones, alcohols and some fatty acids could be obtained.

Figure 8:
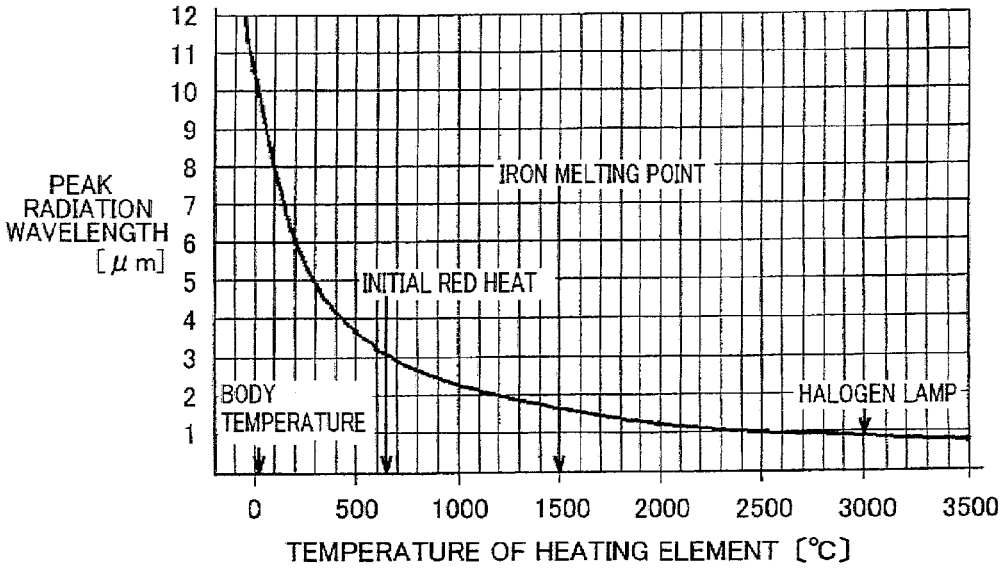
FIG. 8 represents a relation between a temperature of a heating element and peak value of radiation wavelength.
Figure 9:
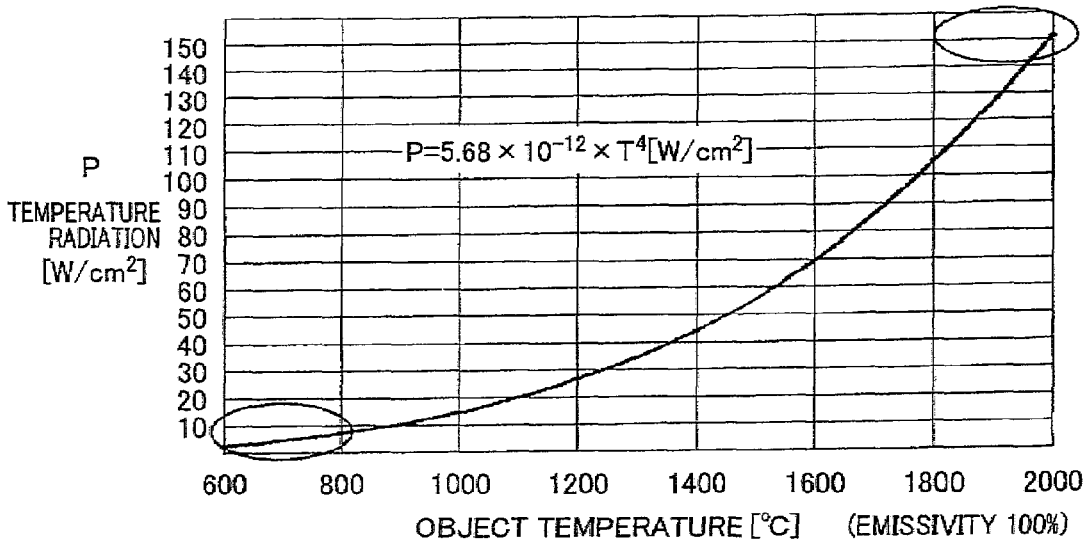
FIG. 9 represents a relation between the temperature of the heating element and temperature radiation.

Generally, a halogen lamp has spectral characteristic of wide range from ultra-violet to infrared range, and has a peak wavelength of about 1 μm. On the other hand, a sheathed heater or a dryer has a peak wavelength of about 3 μm. FIG. 8 represents a relation between a temperature of a heating element and peak value of radiation wavelength. Referring to FIG. 8, when the radiation wavelength is shorter, the temperature of the heating element increases more rapidly. The temperature of the heating element such as the sheathed heater is about 600 to 800° C. (peak wavelength of about 3 μm), while the temperature of halogen lamp as the heating element is 2000 to 3000° C. (peak wavelength of about 1 μm). FIG. 9 represents a relation between the temperature of the heating element and temperature radiation. Referring to FIG. 9, when the temperature of the heating element becomes higher, the amount of temperature radiation increases (Stefan-Boltzmann law). Temperature radiation of the sheathed heater or the like is 5 W/cm$^2$ (temperature of the heating element: 600 to 800° C.), while the temperature radiation of the halogen lamp is 150 W/cm$^2$ (temperature of the heating element: 2000 to 3000° C.). From this result, it can be seen that the temperature radiation of the halogen lamp is several tens of times that of a sheathed heater. Further, about 90 percent of the input energy is radiated as heat from the halogen lamp. Therefore, halogen lamp can effectively transmit energy to the clothes, and hence, it is suitable for generating volatile substances.

As described above, a light source having a peak wavelength in visible light to infrared range including a halogen lamp is suitable for generating volatile substances, and hence can add the fragrance efficiently to the clothes.

The drying system represents a path for heating the air to evaporate water and dehumidify the clothes. The drying system mainly consists of water tank 107, washing tank 106, cooler 108, circulating fan 105 and air heater 104 communicated to cooler 108 and circulating air, and a temperature sensor 103.

The operation of the washing and drying machine in accordance with the present embodiment will be described. The operation of the washing and drying machine of the present embodiment includes the washing and drying processes performed by the conventional washing and drying machine. In the present embodiment, light irradiating step is further provided.

First, the washing process will be described. The washing process includes three steps of washing, rinsing and spin-drying. In the washing step, in response to a control signal from micon 120, motor 109 is rotated forward/backward, so that washing tank 106 directly connected to motor 109 is also rotated forward/backward. At this time, as baffle 110 provided fixed on the inner circumferential surface of washing tank 106 brings clothes 6 up and down, clothes are washed utilizing the so-called tumble-wash effect.

At the end of the washing step, drain pump 111 is driven so that the water is discharged through drain hose 114. Then, the operation proceeds to rinsing and spin-drying steps, and the washing process ends.

The operation in the drying process will be described. When the drying operation starts after the end of the washing process, washing tank 106 rotates forward/backward, and the clothes are moved up and down, causing the turning effect, while power is fed to circulating fan 105 and air heater 104, so that the air temperature increases. Water is evaporated from the heated clothes and enters cooler 108.

To cooler 108, cooling water has been supplied from a cooling water inlet 115 provided opposing thereto at an upper portion, so that the evaporated water is cooled and condensed. The water then flows to drain pump 111, mixed with the cooling water and discharged.

The dehumidified air is fed back to air heater 104 and heated, and the heated air enters washing tank 106, heats clothes 6 and evaporates water from the clothes. By the repetition of this operation, the operation of drying clothes proceeds.

In FIG. 5, white arrows represent the "air circulating path," and black arrows represent the "cooling water path."

The source of heat for heating the clothes in this cycle is air. As air heater 104, a sheathed heater formed by covering a resistance-heating wire with metal is provided in the air circulating duct. The output from temperature sensor 130 is detected by micon 120, and air heater 104 is controlled by micon 120, so that the temperature in washing tank 106 is adjusted while the drying process proceeds.

At the end of the drying process, there is a cool down period in which the air is circulated while air heater 104 is turned OFF, followed by the irradiating step in which the inside of washing tank is kept at a temperature not lower than 40° C. and lower than 70° C. under the control of micon 120, and the light beam is emitted for about 30 minutes from light irradiating unit 103. At this time, by the control signal from micon 120, motor 109 is rotated forward/backward, so that washing tank 106 directly connected to motor 109 is also rotated forward/backward. The forward/backward rotation of washing tank 106 brings clothes 6 up and down, whereby clothes are uniformly irradiated with the light beam. This step realizes the fragrance and comfortable feeling close to those attained by sun-drying.

In order to find optimal conditions to attain the fragrance and comfortable feeling close to those attained by sun-drying, an experiment to collect temperature data in the washing tank when drying operation is performed by the washing and drying machine, and a sensory analysis of fragrance with temperature and time varied were conducted.

Figure 10:
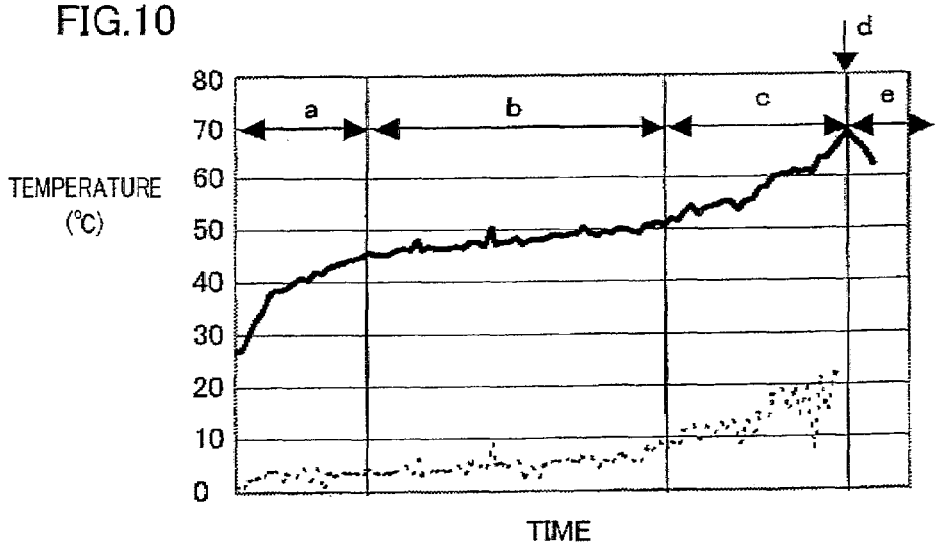
FIG. 10 represents temperature data measured as an experimental result of drying operation by the washing and drying machine shown in FIG. 5.

FIG. 10 represents exemplary temperature data measured as an experimental result of drying operation by the washing and drying machine in accordance with the present embodiment. The solid line represents the temperature of air exhausted from the washing tank, and the dotted line represents difference between the temperature of exhaust air and the temperature of cooling water.

The drying process is typically divided into pre-heat drying step a, constant rate drying step b, and reduced rate drying step c. The pre-heat drying step a corresponds to the start of the drying step, in which heating of the air by air heater 104 starts. The constant rate drying step b corresponds to a step in which the temperature reaches the equilibrium state, as the applied heat is used for evaporating water from the clothes. The reduced rate drying step c corresponds to a step in which much water has been evaporated from the clothes and the applied heat is mainly used for increasing the temperature of the clothes. When the drying step proceeds and micon 120 detects that a prescribed temperature is reached (drying end point d), the heater is turned OFF, and the operation proceeds to cool down e. Immediately after the start of cool-down, the temperature of the air exhausted from washing tank 106 is about 60° C. to 70° C., and possibly exceeds 70° C.

Table 2 shows the result of sensory analysis of fragrance of cotton towel irradiated with the light beam from a halogen lamp having a ultra-violet ray shielding and absorbing glass provided at the front surface, with temperature and time varied.

TABLE 2

| | temp. | 10 min. | 30 min. | 60 min. |
|---|---|---|---|---|
| halogen lamp | 40° C. | + | +++ | +++ |
| halogen lamp | 50° C. | +++ | +++ | +++ |
| halogen lamp | 60° C. | +++ | | +++ |
| halogen lamp | 70° C. | | Δ | |

In Table 2 showing the result of sensory analysis, the mark + represents fragrance attained when dried outdoors, +++ represents comfortable fragrance close to that attained by sun-drying, and Δ represents a slightly spicy fragrance. From the results, it can be understood that when the temperature is 40° C. and irradiation is performed for about 10 minutes, though the fragrance of outdoor-drying can be attained, it is somewhat unsatisfactory. When the temperature is 70° C., some spicy or smoky fragrance generates. Therefore, we can conclude that preferable temperature range for irradiation is not lower than 40° C. and lower than 70° C. In the drying process and immediately after the start of cool-down, the temperature is often out of the optimal temperature range (not lower than about 40° C. and lower than about 70° C.), and in such a case, irradiation is not desirable.

Therefore, in the present embodiment, irradiating step is provided in which the washing tank is kept in the optimal temperature range (not lower than 40° C. and lower than 70° C.) after cool down and the light beam is emitted. In the irradiating step, the light beam is emitted in a short period of time immediately before the end of the entire washing operation to add the fragrance, so that the comfort of sun-drying can be realized when the clothes are taken out.

It is noted that the irradiating step may be started during cool-down, by the control of micon 120 such that the light beam is emitted only when the inside of the washing tank is in the optimal temperature range (not lower than 40° C. and lower than 70° C.).

In the washing and drying machine, the door unit has the door lock 140 for locking the door in the closed state, in order to prevent leakage of water when water level in the water tank exceeds a prescribed value, to prevent possible injury during high speed rotation, or to prevent burning when the temperature inside the rotary drum exceeds a prescribed value during the drying process. In the present embodiment, door lock 140 is activated also in the irradiating step by the control of micon 120, so as to prevent the user or any person or object near the washing and drying machine from possible burning by the light beam or hot air.

It is noted, however, that when the user instructs to temporarily suspend the operation, the light source and the heat source are stopped and air is blown for a prescribed time period to cool down the light source and surroundings, and when the temperatures around the light source and in the washing tank attain low enough not to cause burning, the door can be unlocked.

Fourth Embodiment

Figure 11:
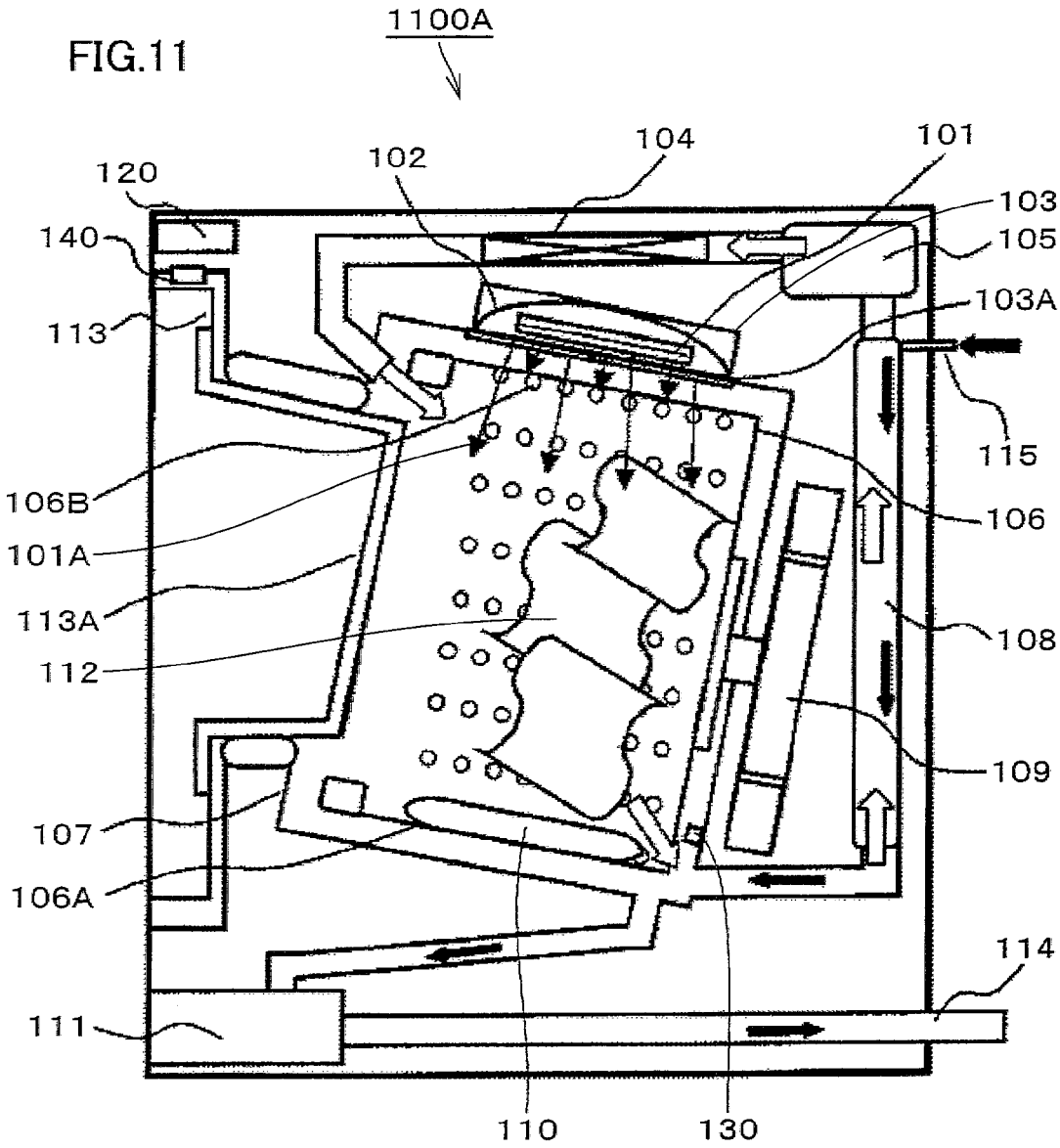
FIG. 11 is a cross-sectional side view representing a schematic structure of a washing and drying machine in accordance with a fourth embodiment of the present invention.

FIG. 11 is a cross-sectional side view of a drum-type washing and drying machine 1100A in accordance with a fourth embodiment.

The washing and drying machine 1100A of the present embodiment is a modification of the washing and drying machine 1100 in accordance with the third embodiment. The main structure is the same as that shown in FIG. 5, except that light irradiating unit 103 is mounted on water tank 107. This is to prevent clothes 112 existing close to the light source 101 that emits heat wave including visible light to infrared ray from being locally heated. As the light irradiating unit 103 is mounted on water tank 107 and is turned on, washing tank 106 is heated and clothes 112 are directly irradiated with light beams 101A that leak through large number of small through holes 106B opened in the circumferential wall of washing tank 106. As a result, it becomes possible to add sun-dried-like fragrance uniformly to clothes 112.

Similar to the example of FIG. 5, light irradiating unit 103 includes a reflector 102 for reflecting light emitted from irradiating light source 101 to the side of washing tank 106, and a heat-resistant protective glass 103A having high ultra-violet shielding and absorbing characteristics for protecting irradiating light source 101 from washing water and water resulting from spin-drying.

By the above-described structure and control, a washing and drying machine can be realized that adds the fragrance similar to that attained by sun-drying to the clothes.

As described above, the method of generating and adding to the laundry the sun-dried fragrance using the light source not including ultra-violet ray or the light source having the ultra-violet ray component removed by the shielding and absorbing glass by the washing and drying machine of the present embodiment can suppress degradation of the clothes and realizes the fragrance and comfort similar to those attained by sun-drying.

By emitting a light beam to add the sun-dried like fragrance, it is possible to provide the sun-dried-like fragrance with the dry clothes or textile product that is not usually washed. Specifically, by the control such that the light is emitted while the temperature inside the washing tank is in the range of 40° C. to lower than 70° C., irradiation becomes possible under the optimal condition to realize the fragrance and comfort similar to those attained by sun-drying. As a result, the fragrance can be added efficiently.

Further, as the fragrance is added immediately before the end of drying when the clothes are taken out, fresh fragrance can be enjoyed.

In the irradiating step, the font door is locked closed, to prevent the door from opening while the light source is on. This prevents any person near the washing and drying machine from burning or injury by the light beam or hot air.

Descriptions of the present embodiment directed to portions similar to those of the third embodiment above are not repeated.

Fifth Embodiment

Figure 12:
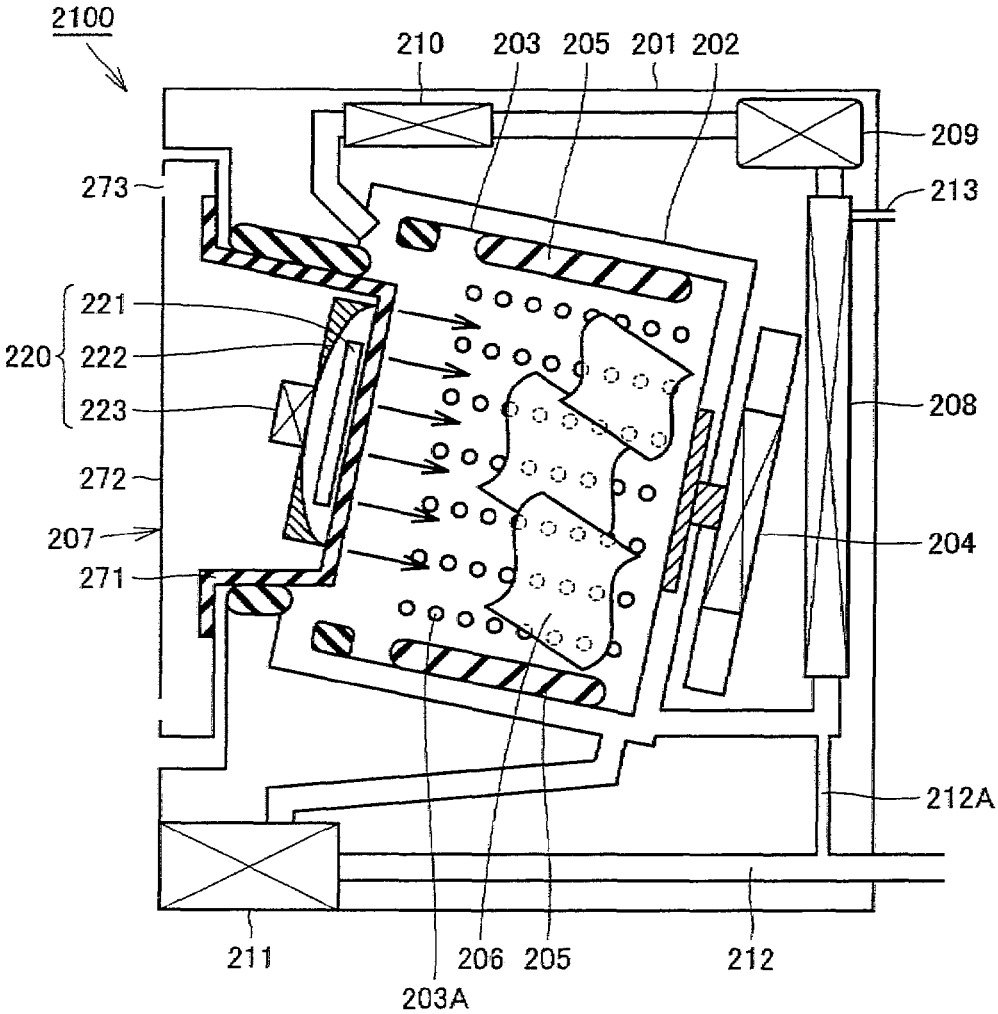
FIG. 12 is a cross-sectional side view representing a schematic structure of a washing and drying machine in accordance with a fifth embodiment of the present invention.

FIG. 12 is a cross-sectional side view showing a washing and drying machine in accordance with a fifth embodiment.

Referring to FIG. 12, a washing and drying machine 2100 in accordance with the present embodiment includes a main body 201, a water tank 202 and a rotary drum 203 provided in main body 201, and a motor 204 rotating rotary drum 203.

Rotary drum 203 accommodates clothes 206 as the object of washing/drying. On an inner circumferential surface of rotary drum 203, small holes 203A and a baffle 205 are provided. Baffle 205 turns clothes 206 in rotating rotary drum 203.

On rotary drum 203, a door unit 207 is provided to open/close the main body 201 (opening of rotary drum 203). During the operation of washing and drying machine 2100, door unit 207 is closed. When door unit 207 is opened, clothes 206 can be put in and taken out.

As devices forming a dryer for drying clothes, a dehumidifying unit 208, a circulating fan 209 and a heater 210 are provided. To dehumidifying unit 208, cooling water is supplied through a cooling water inlet 213. Typically, a sheathed heater having a resistance-heating wire covered with metal is used as heater 210. Operations of these devices during the clothes drying process will be described later.

Water tank 202 is communicated to the outside of main body 201 through drain pump 211 and drain hose 212.

Door unit 207 includes a door glass 271, a door front portion 272 and an air inlet/outlet hole 273. A heat-resistant transparent glass is used as door glass 271. A transparent material is also used for door front portion 272. Therefore, even when door unit 207 is closed during the operation of the washing and drying machine 2100, the user can view clothes 206.

Between door glass 271 and door front portion 272, an irradiating unit 220 emitting light including ultra-violet ray is provided. Irradiating unit 220 emits ultra-violet ray (preferably having the wavelength of about 280 nm or longer) to clothes 206 in rotary drum 203. As a result, fragrance close to that attained by sun-drying can be added to clothes 206. Further, as the emitted light does not include any UVC wave (having the wavelength shorter than about 280 nm), degradation of clothes 206 can be suppressed.

Irradiating unit 220 includes an irradiation light source 221, reflector 222 and a blower fan 223. The light from irradiating light source 221 is reflected by reflector 222 and proceeds to the direction represented by the arrow in FIG. 12. Blower fan 223 is provided for cooling portions around irradiating unit 220.

Door front portion 272 is formed to contain a ultra-violet ray absorber. This suppresses leakage of the ultra-violet ray emitted from irradiating unit 220.

On a front side of door unit 207, air inlet/outlet hole 273 is provided, and as blower fan 223 generates an air flow, heat exchange between the outer air and the air around irradiating unit 220 is promoted. Thus, excessive increase in temperature of irradiating unit 220 in the drying process can be prevented and the temperature is controlled within a prescribed range (by way of example, about 60° C. or lower), elongating the life of irradiating light source 221. By the use of reflector 222 or the like, leakage of the ultra-violet ray through air inlet/outlet hole 273 to the outside can be suppressed. Further, while irradiating unit 220 is in operation, door unit 207 is locked in a closed state.

As the irradiating light source 221, a lamp may be used, or alternatively, an LED (Light Emitting Diode) may be used.

Figure 13:
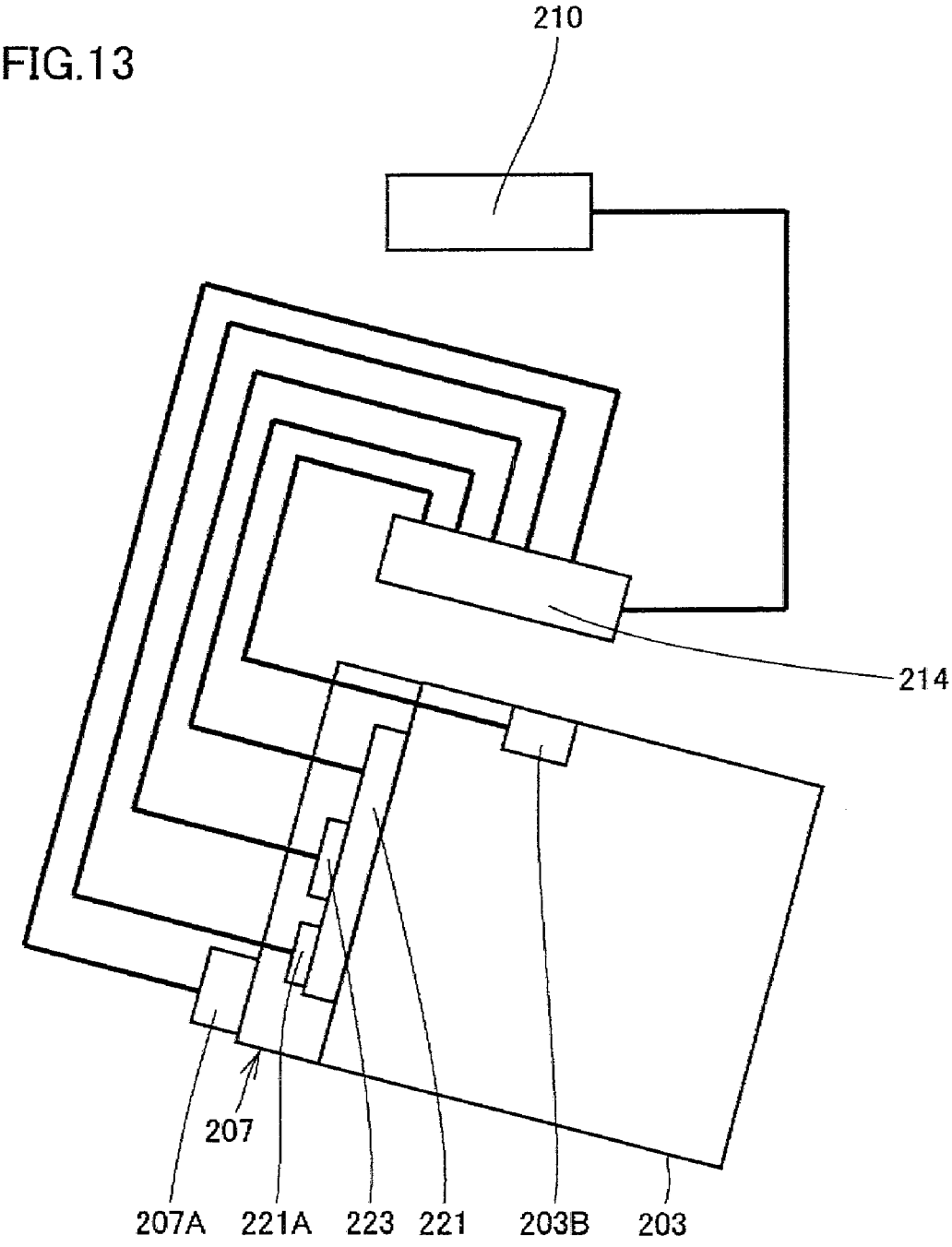
FIG. 13 is a block diagram representing a control means controlling various devices in the washing and drying machine shown in FIG. 12 and devices connected to the control means.

FIG. 13 is a block diagram representing a control means 214 (controller) controlling various devices in the washing and drying machine 2100 and devices connected to the control means.

Referring to FIG. 13, control means 214 is connected to temperature sensors 203B and 221A, heater 210, irradiating light source 221, blower fan 223 and door lock device 207A. Here, temperature sensor 203B detects temperature in rotary drum 203. Temperature sensor 221A detects temperature around irradiating light source 221. Door lock device 207A locks door unit 207 in the closed state. When door lock by door lock device 207A is released, door unit 207 can be opened.

Here, based on the result of detection of the temperature in rotary drum 203 by temperature sensor 203B, lock/unlock by door lock device 207A is controlled, and based on the result of detection of the temperature around irradiating light source 221 by temperature sensor 221A, ON/OFF of blower fan 223 is controlled.

Next, the flow of washing and drying processes by washing and drying machine 2100 will be described.

When there is an input to start washing, amount of clothes 206 put in rotary drum 203 is detected. The amount of clothes 206 is detected, for example, by rotating motor 204 for a prescribed time period in one direction, and by measuring the time from the start to the end of rotation of rotary drum 203.

Based on the detected amount of clothes 206, the amount of water to be fed to water tank 202 and rotary drum 203 is determined, and water is supplied. The water feeding path passes through a detergent inlet, and thus, water with detergent dissolved therein is supplied to water tank 202 and rotary drum 203.

After the water is supplied, motor rotates forward/backward periodically and alternately. Therefore, rotary drum 203 also rotates forward/backward periodically and alternately. Baffle 205 provided on the inner circumferential surface of rotary drum 203 brings clothes 206 up and down, and by the repetition of this operation, washing is done (the so-called tumble-wash effect).

After the end of the washing step, drain pump 211 is driven so that water in water tank 202 and drum 203 is discharged through drain hose 212 to the outside of main body 201. Thereafter, rinsing and spin-drying steps are performed and the washing process ends.

After the end of washing process, drying process is performed. In this process also, rotary drum 203 rotates forward/backward periodically and alternately. Thus, clothes are moved and turned up and down. Here, power is fed to circulating fan 209 and heater 210, and the temperature of the air in rotary drum 203 increases. From the clothes 206 heated by the heated air, water evaporates. The evaporated water is guided together with heated air to dehumidifying unit 208. To dehumidifying unit 208, cooling water is fed from cooling water inlet 213. The water contained in the heated air discharged from rotary drum 203 is condensed in dehumidifying unit 208, and fed to drain hose 212 through drain pipe 212A. The dehumidified air reaches heater 210 through circulating fan 209, and heated again by heater 210 and supplied to rotary drum 203.

During the operation of heater 210 or after the heater 210 is stopped, ultra-violet ray is emitted from irradiating light source 221 to clothes 206 in rotary drum 203 (in the direction represented by the arrow in FIG. 12). The time of ultra-violet irradiation may be arbitrarily selected, and determined, by way of example, in consideration of the weight of clothes 206 in rotary drum 203.

As heater 210 and irradiating light source 221 are operated simultaneously, the heating step and the ultra-violet ray irradiating step proceed simultaneously, and therefore, the time necessary for the entire drying step can be made shorter.

Here, if the clothes 206 have already been irradiated with ultra-violet ray before the clothes 206 are put into washing and drying machine 2100, the step of ultra-violet irradiation may be omitted. In washing and drying machine 2100, irradiating unit 220 can be ON/OFF controlled.

At the end of heating step, operation of heater 210 is stopped, and cool-down step starts. Thus, the temperature of clothes 206 in rotary drum 203 is decreased. Temperature sensor 203B is provided in rotary drum 203 as described above, and based on the result of measurement by temperature sensor 203B, the temperature of clothes 206 can be detected.

In the present embodiment, when it is confirmed that the temperature in rotary drum 203 is not lower than 40° C. and not higher than 60° C., the end of drying step is notified, and the door lock device 207A is unlocked. Thus, when clothes 206 are taken out from rotary drum 203, sun-dried-like feeling (slightly warm feeling) can be enjoyed.

When door lock device 207A is unlocked, it is confirmed that heater 210 and irradiating light source 221 are OFF. Therefore, accidental opening of door unit 207A can be prevented.

As means for preventing leakage of ultra-violet ray to the outside of washing and drying machine 2100, members such as water tank 202 surrounding rotary drum 203 may be formed of a ultra-violet absorber, or a ultra-violet absorber may be provided on members such as water tank 202.

In washing and drying machine 2100, irradiating unit 220 is provided in door unit 207. Therefore, it is possible to simultaneously detect that door unit 207 is closed and that irradiating unit 220 is in a state ready to emit ultra-violet ray to the inside of rotary drum 203.

Figure 17:
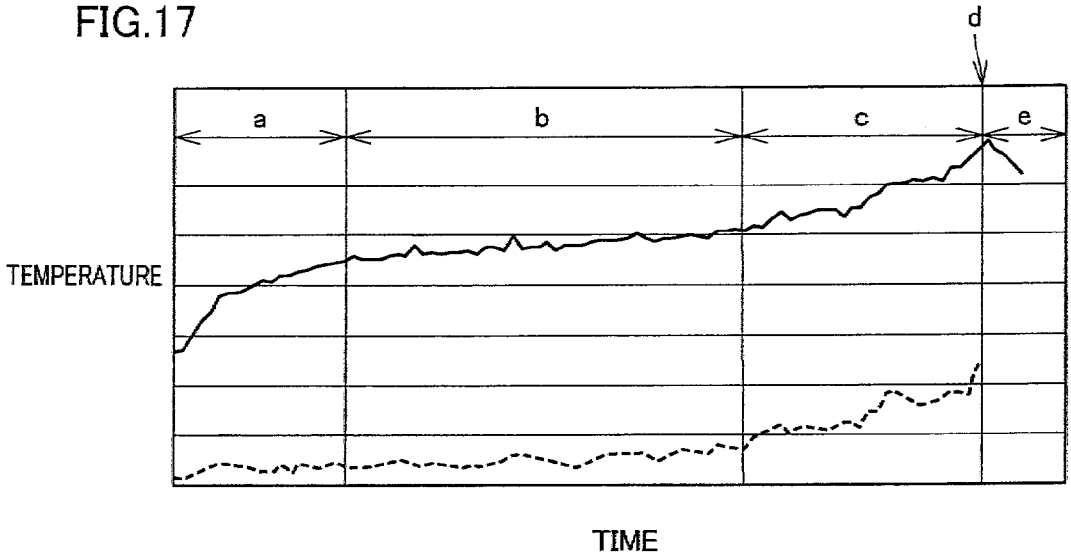
FIG. 17 represents an exemplary relation among time lapse in the drying process of the washing and drying machine shown in FIG. 12, drum exhaustion temperature, and a difference between dram exhaustion temperature and cooling water temperature.

FIG. 17 represents relation among time lapse in the drying process, drum exhaustion temperature (temperature of the air exhausted from rotary drum 203), and a difference between dram exhaustion temperature and cooling water temperature (temperature of the water supplied from cooling water inlet 213). The solid line in FIG. 17 represents the drum exhaustion temperature and the dotted line in FIG. 17 represents the difference between the dram exhaustion temperature and cooling water temperature.

Referring to FIG. 17, the drying process is classified into pre-heat drying step ("a" in FIG. 17), constant rate drying step ("b" in FIG. 17), reduced rate drying step ("c" in FIG. 17) and cool down step ("e" in FIG. 17). The point at the end of drying ("d" in FIG. 17) is the boundary between the reduced rate drying step ("c") and cool down step ("e"), at which heater 210 is switched from ON to OFF.

In the pre-heat drying step, the temperature of air exhausted from rotary drum 203 increases gradually. In the constant rate drying step, the temperature of air exhausted from rotary drum 203 is almost constant. In the reduced rate drying step, most of the water in cloths 206 has been evaporated, and the temperature of air exhausted from rotary drum 203 increases again. From the pre-heat drying step to the constant rate drying step, the difference between the drum exhaustion temperature and the cooling water temperature is almost constant. In the reduced rate drying step, the difference between the drum exhaustion temperature and the cooling water temperature increases.

The inventors studied when to start ultra-violet ray irradiation during the drying process. Specifically, in washing and drying machine 2100, ultra-violet ray irradiation by irradiating unit 220 was started during each of the steps ("a" to "e") and after the end of the cool down step, irradiation was continued for the same time period (60 minutes), and the resulting feeling was evaluated by the same subject(s). The evaluation was given in four ranks, that is, "+++: comfortable fragrance close to that attained by sun-drying," "++: fragrance close to that attained by sun-drying, though weak," "+: fragrance attained when dried outdoors," and "Δ: slightly spicy fragrance." The result of evaluation is as shown in Table 3.

TABLE 3

| irradiation start point | time of irradiation | evaluation |
|---|---|---|
| pre-heat drying step | 60 min. | +++ |
| constant rate drying step | 60 min. | +++ |
| reduced rate drying step | 60 min. | +++ |
| cool down step | 60 min. | +++ |
| after the end of drying operation | 60 min. | +++ |

Referring to Table 3, the evaluation was the same (+++: comfortable fragrance close to that attained by sun-drying), no matter when ultra-violet ray irradiation was started. Therefore, we may conclude that ultra-violet ray irradiation by irradiating unit may be started at any time point.

The inventors further studied whether the effect of ultra-violet ray irradiation (comfortable fragrance) was lost by washing or the like. Specifically, clothes 206 that had been irradiated with ultra-violet ray by irradiating unit 220 were subjected to boiling and other processes, and the resulting feeling were evaluated thereafter by the same subject(s). The evaluation is given in four ranks as in Table 3. The result of evaluation is as shown in Table 4.

TABLE 4

| process | evaluation |
|---|---|
| boiling | +++ |
| washing | ++ |

TABLE 4-continued

| process | evaluation |
|---|---|
| excessive drying | +++ |
| boiling + washing | ++ |
| washing + excessive drying | +++ |
| boiling + washing + excessive drying | +++ |

Referring to Table 4, even when subjected to washing or boiling, fragrance close to that attained by sun-drying could be enjoyed if the clothes had been irradiated with ultra-violet ray. The possible cause is that by ultra-violet ray irradiation, "fragrance component" (such as chain hydrocarbons and aldehydes with carbon number of 6 to 15) has become more volatile from fibers, and even after washing or the like, such "fragrance component" volatilizes from the fiber. The fact that the best evaluation of "+++: comfortable fragrance close to that attained by sun-drying" could be attained when heat treatment such as "boiling" or "excessive heating" was performed at the end may indicate that such treatment increases the afore-mentioned volatility.

As described above, dependent on the past history of ultra-violet irradiation, sun-dried-like feeling can sufficiently be attained even when the ultra-violet ray irradiating step is omitted. Further, in order to facilitate volatilization of "fragrance component," it is effective to perform ultra-violet irradiation only, by operating only the irradiating unit 220.

It is naturally understood that the idea described above may be applied to a clothes dryer that performs the drying process only (not performs the washing process).

The foregoing description will be summarized.

The washing and drying machine 2100 in accordance with the present embodiment is capable of performing at least one of the washing process and the drying process, and includes main body 201, water tank 202 provided in main body 201, rotary drum 203 provided in water tank 202 for accommodating clothes 206 (object of washing/drying), motor 204 for rotating rotary drum 203, drain pump 211 and drain hose 212 (drain path) for guiding water in rotary drum 203 to the outside of the main body 201, door unit 207 (door portion) provided on an opening of rotary drum 203 in main body 201, heater 210 (heating means) for heating the inside of rotary drum 203 with door unit 207 closed, temperature sensor 203B (temperature detecting means) for detecting temperature in rotary drum 203, and control means 214 responsive to the detection by temperature sensor 203B that the temperature in rotary drum 203 has lowered to a prescribed temperature range (for example, not lower than about 40° C. and not higher than about 60° C.) after the operation of heater 210 is stopped, ending the drying process and notifying the end of the drying process.

In washing and drying machine 2100, it is possible to perform the washing and drying processes consistently, and further, it is possible to select a course of operation in which only one of the washing and drying processes is performed.

As the notification of the end of drying process, an audible notification such as an alarm sound, or visible notification such as light may be possible.

As the drying step ends after the temperature in rotary drum 203 is decreased, it becomes possible to have clothes 206 taken out from rotary drum 203 at a temperature close to that attained when the clothes 206 are sun-dried.

From a different aspect, the above structure may be described as a washing and drying machine 2100 including main body 201, water tank 202 provided in main body 201, rotary drum 203 provided in water tank 202 for accommodating clothes 206 (object of washing/drying), motor 204 for rotating rotary drum 203, drain pump 211 and drain hose 212 (drain path) for guiding water in rotary drum 203 to the outside of the main body 201, door unit 207 (door portion) provided on an opening of rotary drum 203 in main body 201, heater 210 (heating means) for heating the inside of rotary drum 203 with door unit 207 closed, and a control means 214 controlling heater 210 such that the temperature in rotary drum 203 is within a prescribed temperature range (for example, not lower than about 40° C. and not higher than about 60° C.) when the clothes 206 are to be taken out at the end of the drying process.

Further, washing and drying machine 2100 includes irradiating unit 220 (ultra-violet ray irradiating means) emitting ultra-violet ray to the inside of rotary drum 203. The drying process of washing and drying machine 2100 includes the step of ultra-violet ray irradiation by irradiating unit 220.

It is noted that only the ultra-violet ray may be emitted, or ultra-violet ray and visible light/infrared ray may be emitted from irradiating unit 220.

As clothes 206 are irradiated with ultra-violet ray, feeling closer to that attained by sun-drying can be attained. Further, sterilization effect by the ultra-violet ray can also be expected.

The ultra-violet ray emitted from irradiating unit 220 preferably has the wavelength of about 280 nm or longer (the range not including UVC wave). This prevents degradation of the object of drying.

Preferably, washing and drying machine 2100 further includes input means for ON/OFF control of irradiating unit 220. This enables selection of turning ON/OFF the ultra-violet ray irradiating step.

Further, it is possible to control ON/OFF of heater 210, so as to omit the heating process by heater 210 and perform only the ultra-violet ray irradiating process.

In the drying process, at least part of the ultra-violet ray irradiating step by irradiating unit 220 and at least part of the heating step by heater 210 may be performed simultaneously. This reduces the time necessary for the drying process.

Preferably, while the drying process proceeds, door unit 207 is locked in the closed state, and after the end of the drying process, the door is unlocked. This prevents accidental opening of door unit 207.

Further, preferably, a ultra-violet ray absorber is arranged to surround rotary drum 203. This suppresses leakage of the ultra-violet ray to the outside of the main body. The ultra-violet ray absorber may be kneaded in the material forming water tank 202 or the like, or it may be attached to water tank 202 or the like.

The idea described above may be applied to a clothes dryer that can perform the drying process only for drying clothes 206. The clothes dryer has, similar to washing and drying machine 2100, rotary drum 203 and the like, and similar to washing and drying machine 2100, includes a control means responsive to the detection by temperature detecting means that the temperature in the drum has lowered to a prescribed temperature range after the operation of the heating means is stopped, ending the drying process and notifying the end of the drying process.

Sixth Embodiment

Figure 14:
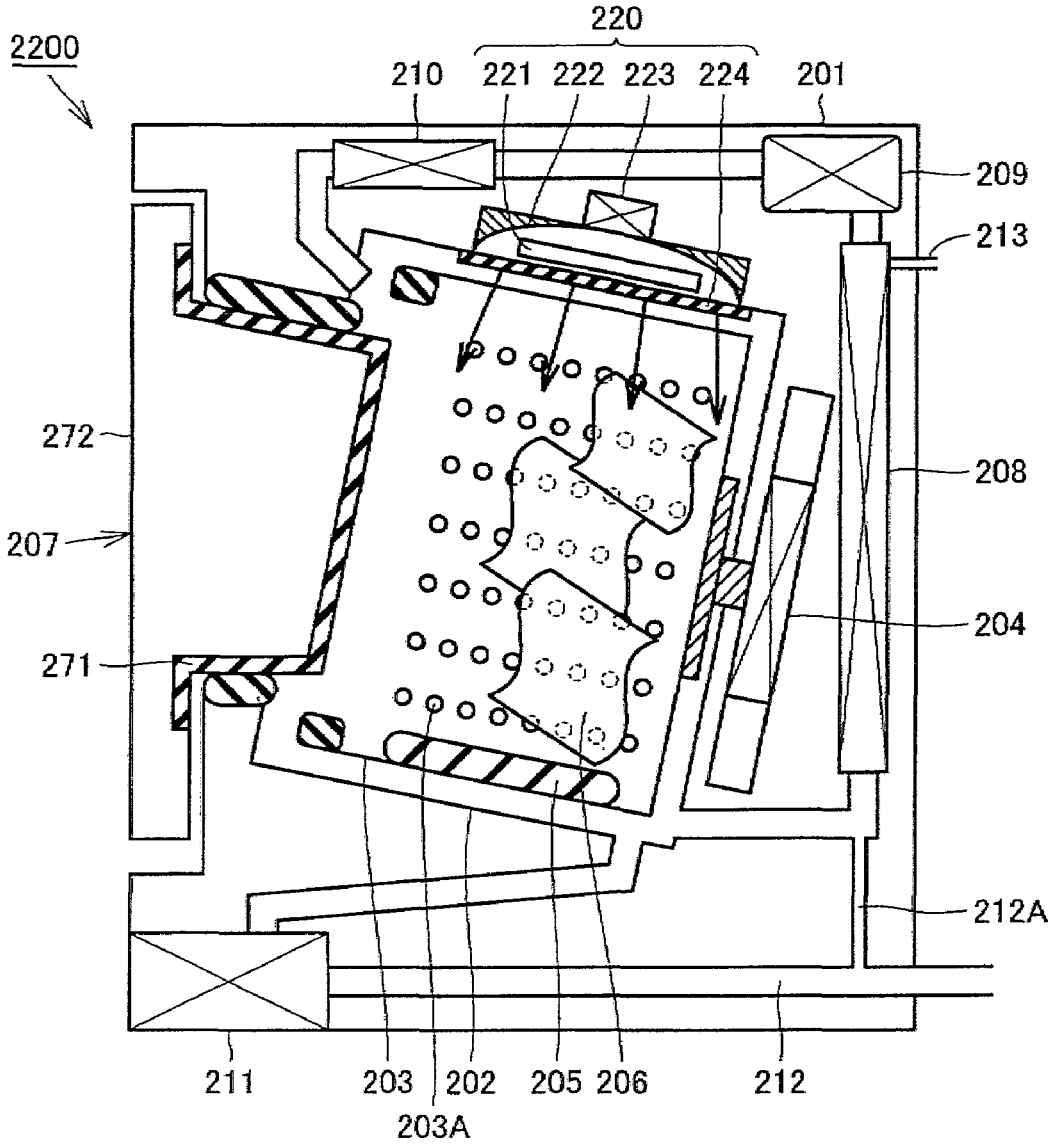
FIG. 14 is a cross-sectional side view representing a schematic structure of a washing and drying machine in accordance with a sixth embodiment of the present invention.

FIG. 14 is a cross-sectional side view representing a washing and drying machine 2200 in accordance with a sixth embodiment.

The washing and drying machine 2200 of the present embodiment is a modification of the washing and drying machine 2100 in accordance with the fifth embodiment, characterized in that irradiating unit 220 emitting ultra-violet ray is mounted on water tank 202. A heat-resistant glass 224 is provided on irradiating unit 220.

In washing and drying machine 2200, the ultra-violet ray emitted from irradiating unit 220 passes through small holes 203A provided in rotary drum 203 and reaches clothes 206 in rotary drum 203.

Figure 15A:
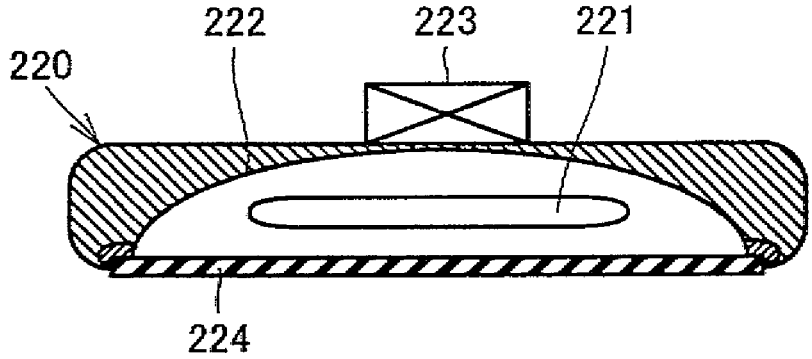
FIG. 15A is a schematic cross-sectional side view representing a ultra-violet ray irradiating unit.
Figure 15B:
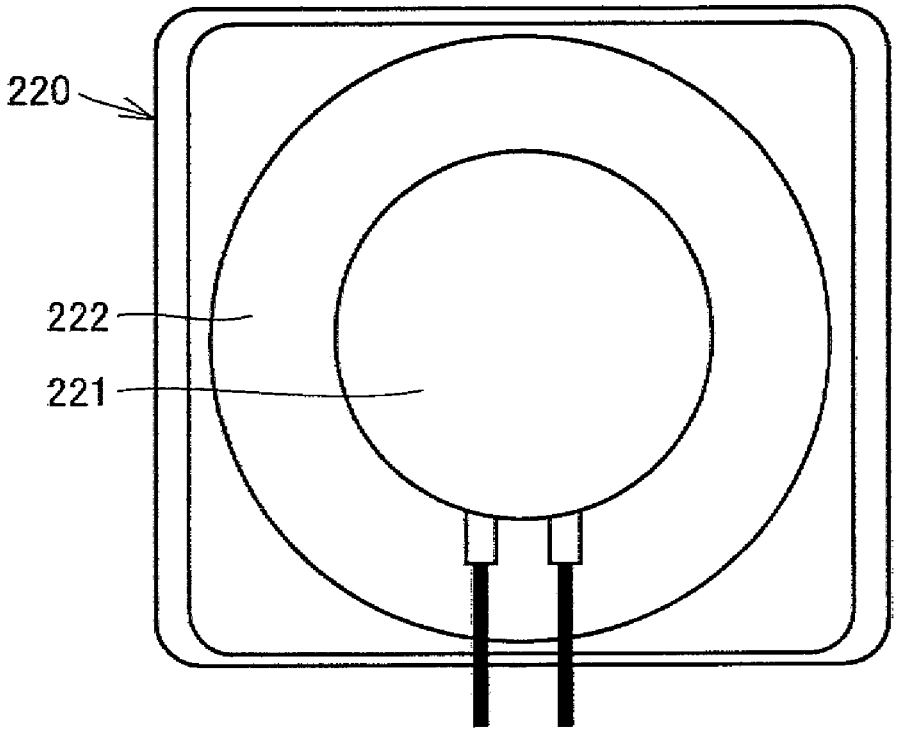
FIG. 15B is a schematic front view representing a ultra-violet ray irradiating unit.

FIGS. 15A and 15B show irradiating unit 220 described above, FIG. 15A a cross-sectional side view and 15B a front view.

Referring to FIGS. 15A and 15B, behind irradiating light source 221, a reflector 222 having high reflectance (such as one formed of aluminum or stainless steel) is provided. The shape of irradiating light source 221 may be varied arbitrarily. Outside the reflector 222, a water-resistant metal case is provided. The water-resistant case is formed, for example, of stainless steel or galvanized steel. Blower fan 223 is provided to prevent excessive increase of the temperature around irradiating light source 221. It may be omitted if the structure of the washing and drying machine has low possibility of excessive increase in temperature. As heat-resistant glass 224, crystalline glass or the like having high heat-resistance and shock-resistance is used. As described above, irradiating unit 220 both has water-resistance and heat-resistance.

In the present embodiment also, as in the fifth embodiment, a washing and drying machine can be provided that provides the feeling close to that attained by sun-drying, by adjusting the temperature in rotary drum 203 at the end of the drying process. Further, as compared with the fifth embodiment, clothes 206 in rotary drum 203 can be irradiated with ultra-violet ray (and visible light and infrared ray) more uniformly.

Descriptions of the present embodiment directed to portions similar to those of the fifth embodiment above are not repeated.

Seventh Embodiment

Figure 16:
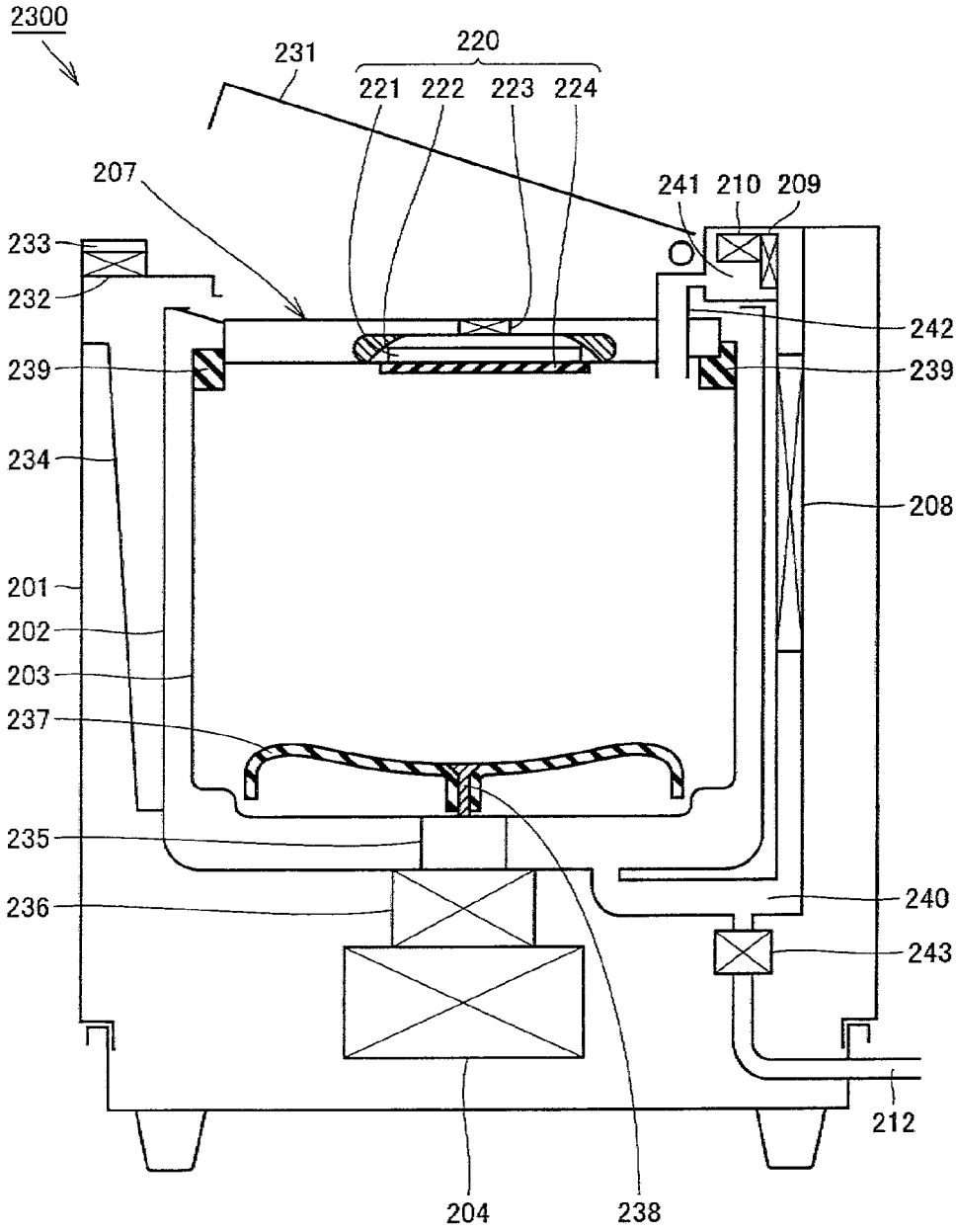
FIG. 16 is a cross-sectional side view representing a schematic structure of a washing and drying machine in accordance with a seventh embodiment of the present invention.

FIG. 16 is a cross-sectional side view representing a washing and drying machine in accordance with a seventh embodiment.

The washing machine 2300 of the present invention is a modification of the washing and drying machine of the fifth and sixth embodiments, and characterized in that water tank 202 opened at the top is provided.

Washing and drying machine 2300 includes main body 201, water tank 202 in main body 201, and rotary drum 203 in water tank 202. At an upper portion of main body 201, a door 231 for opening/closing is provided, and door unit 207 having irradiating unit 220 is provided above water tank 202. As irradiating unit 220, one similar to that of the fifth and sixth embodiments is used.

At an upper front portion of main body 201, an operation panel 233 having control portion 232 is provided. Water tank 202 is swingably suspended in main body 201 by a suspending device 234. At the bottom of rotary drum 203, a hollow cylindrical tank shaft 235 is provided. Tank shaft 235 is supported by a bearing 236. On an inner surface at the bottom of rotary drum 203, a pulsator 237 is provided that generates a water flow by rotation. Pulsator 237 is fitted in tank shaft 235 by means of a pulsator shaft 238. When power is fed to motor 204, pulsator 237 (and pulsator shaft 238) rotates. Further, at the lower portion of pulsator shaft 238, a clutch mechanism (not shown) having an electromagnetic solenoid is provided, and when power is fed to electromagnetic solenoid, pulsator shaft 238 and tank shaft 235 are coupled, and pulsator 237 and rotary drum 203 rotate integrally. Further, above rotary drum 203, a balancer 239 is provided. Rotary drum 203 may have small holes formed in its inner wall.

At the bottom of water tank 202, an opening for exhausting air and draining water is provided. Exhaustion in the drying process is through this opening to exhaust/drain duct 240 and dehumidifying unit 208. The dehumidified air reaches heater 210 thorough circulating fan 209, and heated. The heated air is supplied through hot air supplying path 241 and a hot air supplying hose 242 into rotary drum 203. Further, a blower for cooling (not shown) is provided in main body 201, which blower introduces outer air to main body 201 to cool dehumidifying unit 208 and water tank 202.

Draining of water in the washing process is through exhaust/drain duct 240 to drain hose 212. Exhaust/drain duct 240 and drain hose 212 are connected by means of a drain valve 243 that can be opened/closed. Further, desirably, an electromagnetic valve (not shown) is provided between exhaust/drain duct 240 and dehumidifying unit 208, so as to prevent entrance of drain water in the washing process to dehumidifying unit 208.

The flow of washing process/drying process of washing and drying machine 2300 will be described.

At the start of washing process, first, the amount of clothes (weight) in rotary drum 203 is detected, and water is fed in accordance with the amount. Next, power is fed to motor 204, and pulsator 237 rotates. Thus, the washing step starts. After the end of the washing step, water is once drained, fed again and rinsing step starts. In the washing step/rinsing step, rotary drum 203 is stationary, and pulsator 237 rotates in the stationary rotary drum, so that water flow is generated in rotary drum 203.

When the rinsing step ends, spin-drying step starts. In the spin-drying step, pulsator shaft 238 is coupled with tank shaft 235, so that pulsator 237 and rotary drum 203 rotate integrally. Thus, the washing process ends.

After the end of washing process, drying process is performed. In the initial stage of the drying process, first, pulsator 237 rotates relatively slowly, so that the clothes that have been adhered on the sidewall of rotary drum 237 by the centrifugal force in the spin-drying step come off from the sidewall. Thereafter, by the rotation of pulsator 237, clothes in rotary drum 203 are turned, and as heater 210 operates simultaneously, temperature of clothes 203 increases. Thus, evaporation of water contained in clothes in rotary drum 203 is promoted. Further, at any point during the drying process, ultra-violet ray is emitted by irradiating unit 220.

In the present embodiment also, as in the fifth and sixth embodiment, a washing and drying machine is provided that can attain sun-dried-like feeling, by adjusting the temperature in rotary drum 203 at the end of the drying process.

Descriptions of the present embodiment directed to portions similar to those of the fifth and sixth embodiments above are not repeated.

Although the present invention has been described, it is naturally expected that characteristic portions of each of the above described embodiments may be appropriately combined. Further, it is clearly understood that the disclosed embodiments are by way of illustration and example only and is not to be taken by way of limitation, the spirit and scope of the present invention being limited only by the terms of the appended claims.

INDUSTRIAL FIELD OF APPLICATION

As described above, the present invention is applied to washing and drying machines and clothes dryers.

The invention claimed is:

1. A drying method for a washing and drying machine that includes a water tank and a rotary drum rotatably supported in said water tank, the method comprising:

drying an article in said rotary drum by providing heated air from an outside of said rotary drum into said rotary drum;

cooling down, after said drying step, a temperature inside said rotary drum to at least 30° C. and at most 60° C.; and irradiating, under said temperature and after the drying step, a light beam including ultra-violet ray into said rotary drum to provide sun-dried fragrance to the article.

2. The drying method according to claim 1, further comprising:

controlling said irradiating step such that only an irradiating step of emitting the light beam including ultra-violet ray into said rotary drum can be performed.

3. The drying method according to claim 1, wherein said irradiating step includes, controlling a door provided to open/close an opening of said rotary drum such that the door is locked while the light beam including ultra-violet ray into said rotary drum is irradiated.

4. The drying method according to claim 1, further comprising:

shutting off said ultra-violet ray by a component containing an ultra-violet ray absorber.

5. The drying method according to claim 1, wherein said irradiating step is performed by an irradiating component that is provided on a door provided to open/close an opening of said rotary drum.

6. The washing and drying machine according to claim 1, further comprising:

emitting, by an irradiating component provided on said water tank, the light beam including ultra-violet ray to an outer circumferential surface of said surface of said rotary drum, said light beam being emitted through a plurality of through holes penetrating to the inside of said rotary drum in said outer circumferential surface of said rotary drum.

* * * * *